US007398651B2

(12) United States Patent
Kalina

(10) Patent No.: US 7,398,651 B2
(45) Date of Patent: Jul. 15, 2008

(54) CASCADE POWER SYSTEM

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 602 days.

(21) Appl. No.: 10/983,970

(22) Filed: Nov. 8, 2004

(65) Prior Publication Data

US 2006/0096288 A1 May 11, 2006

(51) Int. Cl.
*F01K 25/06* (2006.01)

(52) U.S. Cl. ..... 60/649; 60/651; 60/653; 60/671

(58) Field of Classification Search ..... 60/649, 60/651, 671, 653
See application file for complete search history.

(56) References Cited

U.S. PATENT DOCUMENTS

| | | | | | |
|---|---|---|---|---|---|
| 4,732,005 | A * | 3/1988 | Kalina | ..... | 60/673 |
| 4,763,480 | A * | 8/1988 | Kalina | ..... | 60/649 |
| 4,817,392 | A * | 4/1989 | Agrawal et al. | ..... | 62/655 |
| 4,832,718 | A * | 5/1989 | Mehra | ..... | 62/635 |
| 5,019,143 | A * | 5/1991 | Mehrta | ..... | 62/625 |
| 5,095,708 | A * | 3/1992 | Kalina | ..... | 60/673 |
| 5,572,871 | A * | 11/1996 | Kalina | ..... | 60/649 |
| 5,649,426 | A * | 7/1997 | Kalina et al. | ..... | 60/649 |
| 5,950,433 | A * | 9/1999 | Kalina | ..... | 60/649 |
| 6,735,948 | B1 | 5/2004 | Kalina | ..... | 60/649 |
| 6,769,256 | B1 | 8/2004 | Kalina | ..... | 60/653 |
| 6,820,421 | B2 | 11/2004 | Kalina | ..... | 60/649 |
| 6,829,895 | B2 | 12/2004 | Kalina | ..... | 60/649 |
| 6,910,334 | B2 * | 6/2005 | Kalina | ..... | 60/651 |
| 6,923,000 | B2 | 8/2005 | Kalina | ..... | 60/649 |
| 6,941,757 | B2 | 9/2005 | Kalina | ..... | 60/649 |
| 6,968,690 | B2 | 11/2005 | Kalina | ..... | 60/649 |
| 7,021,060 | B1 | 4/2006 | Kalina | ..... | 60/649 |
| 7,043,919 | B1 | 5/2006 | Kalina | ..... | 60/651 |
| 7,055,326 | B1 | 6/2006 | Kalina | ..... | 60/649 |
| 7,065,967 | B2 | 6/2006 | Kalina | ..... | 60/649 |
| 7,065,969 | B2 | 6/2006 | Kalina | ..... | 60/670 |
| 2005/0061654 | A1 | 3/2005 | Kalina | ..... | 203/21 |
| 2006/0096290 | A1 | 5/2006 | Kalina | ..... | 60/649 |
| 2006/0165394 | A1 | 7/2006 | Kalina | ..... | 392/386 |
| 2006/0199120 | A1 | 9/2006 | Kalina | ..... | 431/9 |

FOREIGN PATENT DOCUMENTS

WO WO 2004/001288 * 12/2003

OTHER PUBLICATIONS

U.S. Appl. No. 11/514,290, filed Aug. 31, 2006, inventor Kalina.
U.S. Appl. No. 11/399,287, filed Apr. 5, 2006, inventor Kalina.
U.S. Appl. No. 11/399,306, filed Apr. 5, 2006, inventor Kalina.
U.S. Appl. No. 11/238,173, filed Sep. 28, 2005, inventor Kalina.
U.S. Appl. No. 11/235,654, filed Sep. 22, 2005, inventor Kalina.
U.S. Appl. No. 11/227,991, filed Sep. 15, 2005, inventor Kalina.

* cited by examiner

*Primary Examiner*—Hoang M Nguyen
(74) *Attorney, Agent, or Firm*—Robert W Strozier

(57) ABSTRACT

A cascade power system and a method are disclosed for using a high temperature flue gas stream to directly or indirectly vaporize a lean and rich stream derived from an incoming, multi-component, working fluid stream, extract energy from these streams, condensing a spent stream and repeating the vaporization, extraction and condensation cycle.

29 Claims, 19 Drawing Sheets

CASCADE POWER SYSTEM

BACKGROUND OF THE INVENTION

1. Field of the Invention

The present invention relates to a cascade power system for extracting usable power from heat produced from the combustion of biomass, agricultural waste (such as bagasse,) municipal waste and other fuels.

More particularly, the present invention relates to a cascade power system for extracting usable power from heat produced from the combustion of biomass, agricultural waste (such as bagasse,) municipal waste and other fuels, where the system includes an energy extraction subsystem, a separation subsystem, a heat exchange subsystem, a heat transfer subsystem and a condensing subsystem, where the system forms a lean stream and a rich stream from a fully condensed incoming working fluid stream, vaporizes the lean and a rich streams from heat derived directly or indirectly from a heat source stream, converts thermal from the lean and rich streams to a usable form of energy forming a spent outgoing working fluid stream and condensing the outgoing working fluid stream to from the incoming working fluid stream and to methods for converting vaporizing a lean stream and a rich stream and extracting energy therefrom.

2. Description of the Related Art

Currently, the most efficient biomass fueled power plants have an overall plant efficiency of up to 20%, i.e. the net power output of these plants is up to 20% of the LHV (Lower Heating Value) of the combusted fuel. To achieve this level of efficiency, current biomass power plants require a very complicated combustion system which is comprised of a gasifier and a char combustor, and a power train that uses both a gas turbine and a steam power system, consequently, such systems are quite expensive.

Thus, there is a need in the art for a more efficient and simpler system for combusting a fuel such as biomass and converting a higher portion of its Lower Heating Value of the combusted fuel in to usable energy such as electricity.

SUMMARY OF THE INVENTION

The present invention provides a cascade power system including two interacting cycles. One cycle utilizes a rich working fluid having a higher concentration of a low boiling component, and another cycle utilizes a lean working fluid having a lower concentration of the low boiling component, where the system is designed on a modular principle, and can be embodied in several variants which may or may not include certain modular units or components.

The present invention provides a cascade power system including an energy extraction subsystem, a separation subsystem, a heat exchange subsystem, a heat transfer subsystem and a condensation subsystem. The system produces a lean stream cycle and a rich stream cycle. In the lean stream cycle, a lean stream is produced from an incoming stream in the separation subsystem, vaporized in the heat exchange subsystem, and a portion of thermal energy is extracted in a lean stream portion of the energy extraction subsystem from the vaporized lean stream. In the rich stream cycle, a rich stream is produced from an incoming stream, vaporized in the heat exchange subsystem and a portion of thermal energy is extracted in a rich stream portion of the energy extraction subsystem from the vaporized rich stream. The spent rich stream from the rich stream portion of the energy extraction system is than condensed in the condensing unit and returned as the incoming stream. The system forms a continuous thermodynamic energy conversion cycle including two interacting subcycles.

The present invention also provides a cascade power system including an energy extraction subsystem having a rich stream extraction subsystem and a lean stream extraction subsystem, a separation subsystem, a heat exchange subsystem, a heat transfer subsystem and a condensing subsystem. The system forms a lean stream and a rich stream from a fully condensed incoming working fluid stream, vaporizes the lean and a rich streams from heat derived directly or indirectly from an external heat source stream, preferably an external hot flue gas stream, converts a portion of thermal energy in the lean and rich streams to a usable form of energy to form a spent outgoing working fluid stream, and condensing the outgoing working fluid stream to from the incoming working fluid stream, where the system supports a thermodynamic energy extraction cycle including two interacting subcycles.

The present invention provides a cascade power system including an energy extraction subsystem, a separation subsystem, a heat exchange subsystem, a heat transfer subsystem and a condensing subsystem, where the system supports a thermodynamic energy extraction cycle. The energy extraction subsystem includes a lean stream turbine, at least one rich stream turbine and at least two throttle control valves, where the lean stream turbine is adapted to extract energy from a lean stream, where the rich stream turbine is adapted to extract from a rich stream and where the first throttle control valve adjusts a pressure of a rich stream to that of a pressure of the rich stream turbine, where a second throttle control valve adjusts a pressure of the lean stream to a pressure of the lean stream turbine and optionally a third throttle control valve adjusts a pressure of an optional rich substream to a pressure of a leaner stream. The separation subsystem includes a scrubber, a separator and three pumps, where the separation subsystem is adapted to form a lean stream and a make-up stream having a composition the same or substantially the same as an incoming working fluid stream. The heat exchange subsystem includes at least four heat exchangers adapted to vaporize the rich stream and heat or partially vaporized the lean stream. The heat transfer subsystem includes a heat transfer fluid, a heat transfer fluid pump and two heat exchangers, where the heat transfer subsystem is adapted to transfer heat from a hot flue gas stream to the heat transfer subsystem and then to transfer the absorbed heat of the heat transfer subsystem to the lean stream to vaporize the lean stream. The condensation subsystem is adapted to a fully condensed the spent working fluid stream and can be any condensation subsystem.

The present invention provides a method including mixing a fully condensed incoming work fluid stream with a pressurized cooled mixed stream, where the incoming stream and the mixed stream have the same or substantially the same composition to form a cooled working fluid stream. The cooled working fluid stream is then brought into a heat exchange relationship with a mixed stream to form the cooled mixed stream and a heated working fluid stream. The heated working fluid stream is then brought into a heat exchange relationship with a first portion of a cooled spent lean stream to from a hotter working fluid stream and a cooler spent lean stream. The hotter working fluid stream is then brought into a heat exchange relationship with a spent lean stream to form a fully vaporized working fluid stream. A first portion of the fully vaporized working fluid stream is then pressure adjusted and forwarded to the rich stream turbine, where the working fluid stream is a rich stream relative to the lean stream. The fully vaporized working fluid stream is then forwarded to the rich stream turbine converting a portion of the thermal energy in the fully vaporized working fluid stream into a first amount of useable form of energy. A second portion of the fully vaporized working fluid stream is then pressure adjusted and mixed with a partially vaporized leaner stream to form the lean stream. The lean stream is then brought into a heat exchange relationship with a circulated heat transfer fluid to form a fully vaporized lean stream, where the heat transfer fluid is heated by bringing the circulating heat transfer fluid into a heat exchange relationship with a hot flue gas stream. The fully vaporized lean stream is then pressure adjusted to a pressure of the lean stream turbine and forwarded to the lean stream turbine converting a portion of the thermal energy in the fully vaporized lean stream into a second amount of useable from of energy.

The present invention provides a method for efficient extraction of energy from a hot flue gas stream including the steps of establishing two interacting vaporization and energy extraction cycles, where one cycle utilizes a multi-component fluid stream having a higher concentration of a low boiling component of the multi-component fluid (a rich stream) and the other cycle utilizes a multi-component fluid stream having a higher concentration of a high boiling component of the multi-component fluid (a lean stream), each stream being derived from a fully condensed incoming multi-component working fluid. The lean and rich stream utilized in the two interacting cycles are directly and/or indirectly vaporized by a hot external flue gas stream, where a portion of the indirect heating occurs via a heat transfer cycle utilizing a separately circulating heat transfer fluid to heat and vaporize the lean stream. Once vaporized, a portion of the thermal energy in the lean stream is extracted in a lean turbine and a portion of the thermal energy in the rich stream is extracted in at least one rich turbine. The spent lean stream is used to heat and vaporize the rich stream and is forwarded to a scrubber and separator designed to form the lean stream and to supplement the rich stream. The spent rich stream is forwarded to a condensation unit, where it is fully condensed to form the incoming stream.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
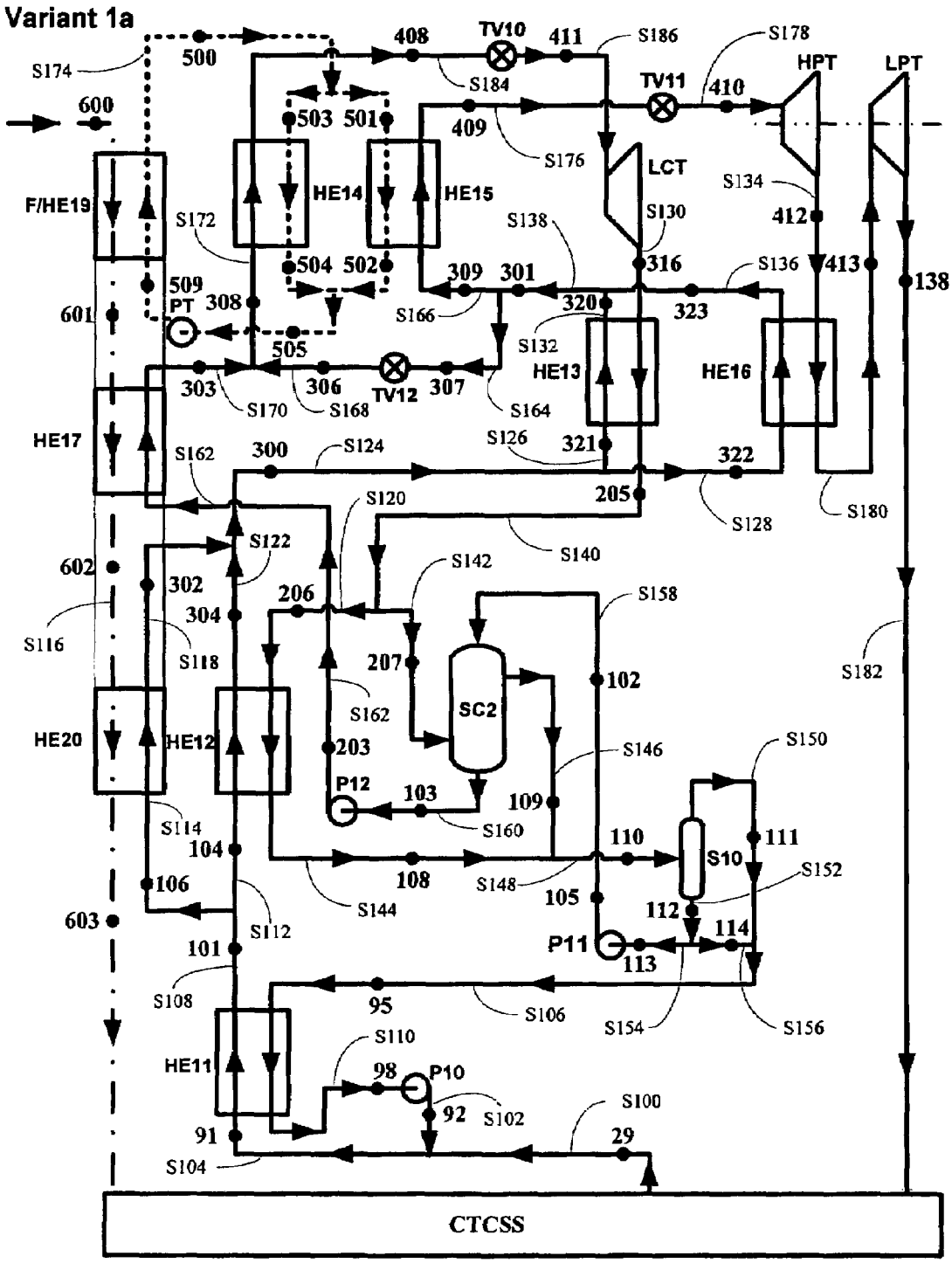
FIG. 1 depicts a block diagram of a preferred embodiment, Variant 1*a*, of a cascade power system of this invention.

The inventor has found that a new system for extracting usable energy from a source of combustion gases with higher efficiency the known systems. The preferred system of this invention have at least a 30% improvement over a known prior art system. The inventor has also found that the new system is ideally suited for extracting the heat produced in the combustion of a fuels preferably low heat value fuels such as biomass, agricultural waste (such as bagasse,) municipal waste and other low heat value fuels. Preferably, the combustion is carried out in fluidized bed combustors or combustion zone. The term biomass is used herein to refer to all low heat value fuels, but, of course, the systems of this invention can also be used with other fuels including high heat value fuels such as coal, oil or natural gas.

The present invention broadly relates to a power system including two interacting thermodynamic different working fluid cycles and a heat transfer cycle. One working fluid cycle utilizes a rich working fluid stream, a stream having a higher concentration of a low boiling component of a multi-component fluid, while the other working fluid cycle utilizes a lean working fluid stream, a fluid stream having a lower concentration of the low boiling component. The cycles are adapted to be fully vaporized by absorbing thermal energy directly and/or indirectly from a hot flue gas stream and the convert a portion of their thermal energy into a usable form of energy in separation energy conversion subsystems. The system also includes a heat transfer cycle adapted to indirectly transfer thermal energy from the hot flue gas stream to vaporize the lean stream prior to energy extraction. The rich stream is vaporized by thermal energy derived from the lean stream and streams derived thereform.

The present invention broadly relates to a cascade power system including an energy extraction subsystem, a separation subsystem, a heat exchange subsystem, a heat transfer subsystem and a condensation subsystem. The system produces a lean stream cycle and a rich stream cycle. In the lean stream cycle, a lean stream is produced from an incoming stream in the separation subsystem, vaporized in the heat exchange subsystem, and a portion of thermal energy is extracted in a lean stream portion of the energy extraction subsystem from the vaporized lean stream. In the rich stream cycle, a rich stream is produced from an incoming stream, vaporized in the heat exchange subsystem and a portion of thermal energy is extracted in a rich stream portion of the energy extraction subsystem from the vaporized rich stream. The spent rich stream from the rich stream portion of the energy extraction system is than condensed in the condensing unit and returned as the incoming stream. The system forms a continuous thermodynamic energy conversion cycle including two interacting subcycles.

The present invention broadly relates to a method including mixing a fully condensed incoming work fluid stream with a pressurized cooled mixed stream, where the incoming stream and the mixed stream have the same or substantially the same composition to form a cooled working fluid stream. The cooled working fluid stream is then brought into a heat exchange relationship with a mixed stream to form the cooled mixed stream and a heated working fluid stream. The heated working fluid stream is then brought into a heat exchange relationship with a first portion of a cooled spent lean stream to from a hotter working fluid stream and a cooler spent lean stream. The hotter working fluid stream is then brought into a heat exchange relationship with a spent lean stream to form a fully vaporized working fluid stream. A first portion of the fully vaporized working fluid stream is then pressure adjusted and forwarded to the rich stream turbine, where the working fluid stream is a rich stream relative to the lean stream. The fully vaporized working fluid stream is then forwarded to the rich stream turbine converting a portion of the thermal energy in the fully vaporized working fluid stream into a first amount of useable form of energy. A second portion of the fully vaporized working fluid stream is then pressure adjusted and mixed with a partially vaporized leaner stream to form the lean stream. The lean stream is then brought into a heat exchange relationship with a circulated heat transfer fluid to form a fully vaporized lean stream, where the heat transfer fluid is heated by bringing the circulating heat transfer fluid into a heat exchange relationship with a hot flue gas stream. The fully vaporized lean stream is then pressure adjusted to a pressure of the lean stream turbine and forwarded to the lean stream turbine converting a portion of the thermal energy in the fully vaporized lean stream into a second amount of useable from of energy.

The present invention broadly relates to a method for efficient extraction of energy from a hot flue gas stream including the steps of establishing two interacting vaporization and energy extraction cycles, where one cycle utilizes a multi-component fluid stream having a higher concentration of a low boiling component of the multi-component fluid (a rich stream) and the other cycle utilizes a multi-component fluid stream having a higher concentration of a high boiling component of the multi-component fluid (a lean stream), each stream being derived from a fully condensed incoming multi-component working fluid. The lean and rich stream utilized in the two interacting cycles are directly and/or indirectly vaporized by a hot external flue gas stream, where a portion of the indirect heating occurs via a heat transfer cycle utilizing a separately circulating heat transfer fluid to heat and vaporize the lean stream. Once vaporized, a portion of the thermal energy in the lean stream is extracted in a lean turbine and a portion of the thermal energy in the rich stream is extracted in at least one rich turbine. The spent lean stream is used to heat and vaporize the rich stream and is forwarded to a scrubber and separator designed to form the lean stream and to supplement the rich stream. The spent rich stream is forwarded to a condensation unit, where it is fully condensed to form the incoming stream.

The preferred embodiments of the system of this invention are high efficiency systems and high efficiency methods that preferably utilize heat produced in a single stage fluidized bed combustor or combustion zone, but can use heat produced by any method that generates a hot flue gas effluent stream.

The system of this invention uses as its working fluid including a mixture of at least two components, where the components have different normal boiling temperatures. That is the working fluid is a multi-component fluid including at least one higher boiling component and at least one lower boiling component. In a two component working fluid, the higher boiling component is often referred to simply as the high boiling component, while the lower boiling component is often referred to simply as the low boiling component. A composition of the multi-component working fluid is varied throughout the system with energy being extracted from a rich working fluid and a lean working fluid, where rich means that the fluid has a higher concentration of the low boiling component than the in-coming working fluid and lean means that the fluid has a lower concentration of the low boiling component than the in-coming working fluid.

The working fluid used in the systems of this inventions is a multi-component fluid that comprises a lower boiling point material—the low boiling component—and a higher boiling point material—the high boiling component. Preferred working fluids include, without limitation, an ammonia-water mixture, a mixture of two or more hydrocarbons, a mixture of two or more freons, a mixture of hydrocarbons and freons, or the like. In general, the fluid can comprise mixtures of any number of compounds with favorable thermodynamic characteristics and solubilities. In a particularly preferred embodiment, the fluid comprises a mixture of water and ammonia.

Suitable heat transfer fluids include, without limitation, metal fluids such as lithium, sodium, or other metal used as high temperature heat transfer fluids, synthetic or naturally derived high temperature hydrocarbon heat transfer fluids, silicon high temperature heat transfer fluids or any other heat transfer fluid suitable for use with hot flue gas effluent stream from fuel combustion furnaces, where the fuel includes biomass, agricultural waste (such as bagasse,) municipal waste, nuclear, coal, oil, natural gas and other fuels.

The system of this invention comprises two interacting cycles. One cycle utilizes a rich working fluid having a higher concentration of the low boiling component, and the other cycle utilizes a lean working fluid having a lower concentration of the low boiling component.

The system of this invention is designed on a modular principle, and can be embodied in several variants which may or may not include certain modular units or components.

Preferred Embodiments

Figure 2:
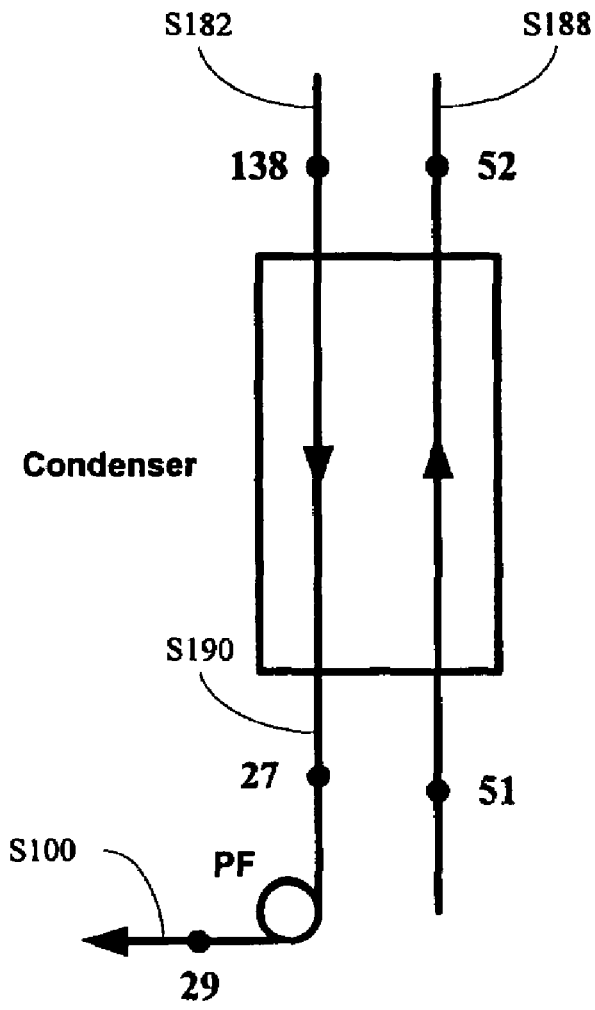
FIG. 2 depicts a block diagram of a simple condenser.

A preferred embodiment of the power system of the present invention is presented in FIG. 1. The system shown in FIG. 1 may operate with a simple condenser as shown in FIG. 2 or may operate with a Condensation Thermal Compression Sub Systems (CTCSS) including a CTCSS described in a co-pending application file simultaneously via express mail label number EV 510 916 550 filed concurrently with this application, incorporated by reference and set forth in FIGS. 10-19, herein.

One preferred embodiment of the system of this invention is the embodiment shown in FIG. 1 is designated Variant 1*a*, and operates as follows. A rich working liquid stream, a stream having a high concentration of the low-boiling component S100 having parameters as at a point 29 enters the system from either a simple condenser of FIG. 2 or a Condensation Thermal Compression Subsystem (CTCSS) of FIGS. 10-19. The stream S100 exits the condenser or CTCSS at a high pressure and having a temperature close to ambient. Thereafter, the stream S100 having the parameters as at the point 29 is mixed with a stream S102 of working fluid having at parameters as at a point 92. Usually the pressure of the stream S102 at point 92 is equal to the pressure of the stream S100 at point 29, and the composition of the stream S102 at point 92 is the same or similar to the composition of the stream S102 at point 29. As a result of this mixing, a stream S104 having parameters as at a point 91 is formed. Thereafter, the stream S104 having the parameters as at the point 91 passes through a first heat exchanger HE11, where it is heated in counterflow in a first heat exchange process by a condensing stream S106 of rich working fluid having parameters as at a point 95, forming a stream S108 having parameters as at a point 101, where a temperature of the stream S108 is sufficient to bring the fluid close to a state of saturated liquid.

The stream S106 of rich working fluid having the parameters as at the point 95 passes through the first heat exchanger HE11, where it is cooled and fully condensed, releasing heat for the first heat exchange process, forming a stream S110 having parameters as at a point 98. Thereafter, the fully condensed stream S110 having the parameters as at the point 98 enters into a first circulating pump P10, where it is pumped to a high pressure equal to the pressure of the stream S100 having the parameters as at the point 29, forming the stream S102 having the parameters as at the point 92. The stream S102 having the parameters as at the point 92 is mixed with the stream S100 having the parameters as at the point 29, forming the stream S104 having the parameters as at the point 91 as described above.

Meanwhile, the stream S108 having the parameters as at the point 101 is divided into two substreams S112 and S114 having parameters as at points 104 and 106, respectively. The stream having S114 having the parameters as at the point 106 passes through a ninth heat exchanger HE20, where it is heated and vaporized in counterflow in a ninth heat exchange process by a steam S116 of flue gas having initial parameters as at a point 602 and final parameters as at a point 603 as described below, forming a stream S118 having parameters as at a point 302, corresponding, or close to, a state of saturated vapor, where close to means that the parameters of the stream are within about 5% of being in a state of saturated vapor.

The stream S112 having the parameters as at the point 104 passes through a second heat exchanger HE12, where it is heated and vaporized in counterflow in a second heat exchange process by a stream S120 of condensing working fluid having parameters as at a point 206, forming a stream S122 having parameters as at a point 304, corresponding or close to a state of saturated vapor, where close to means that the parameters of the stream are within about 5% of being in a state of saturated vapor.

Thereafter, the streams S118 and S122 having the parameters as at the points 302 and 304, respectively, are combined to form a vapor stream S124 having parameters as at a point 300. The vapor stream S124 having the parameters as at the point 300 is then divided into two substreams S126 and S128 having parameters as at points 321 and 322, respectively. The stream S126 having the parameters as at the point 321 then passes through a third heat exchanger HE13, where it is heated in counterflow in a third heat exchange by a lean working fluid stream S130 having parameters as at a 316, forming a stream S132 having parameters as at point 320. The stream S128 having the parameters as at the point 322 passes through an intercooler HE16, where it is heated in counterflow in a sixth heat exchange process by a rich working fluid stream S134 having parameters as at a point 412, forming a stream S136 having parameters as at a point 323. The stream S134 having the parameters as at the point 323 is then mixed with the stream S132 having the parameters as at the point 320, forming a rich working fluid stream S138 having parameters as at a point 301.

The lean working fluid stream S130 having the parameters as at the point 316 exiting a low concentration turbine LCT as described below, passes through the third heat exchanger HE13, where it is cooled, releasing heat in the third heat exchange process as describe above, forming the stream S140 having parameters as at a point 205, corresponding or close to a state of saturated vapor, where close to means that the parameters of the stream are within about 5% of being in a state of saturated vapor. The pressure of the lean working fluid stream S140 at point 205 is substantially lower than a pressure of the rich working fluid stream S124 at point 300, but because the stream S140 having the parameters as at the point 205 has a substantially lower concentration of the low boiling component, it starts to condense at a temperature of the stream S140 at point 205, which is higher than a temperature of the fully vaporized, rich working fluid stream S124 having the parameters as at the point 300, which has a substantially higher pressure.

The returning lean working fluid stream S140 having the parameters as at the point 205 is then divided into two substreams S120 and S142 having parameters as at points 206 and 207, respectively. The stream S120 having the parameters as at the point 206 passes through the second heat exchanger HE12 where it is partially condensed in the second heat exchange process to form a stream S144 having parameters as at a point 108, releasing heat to the stream S114 having the parameters as at the point 104 as described above.

Thereafter, the lean working fluid stream S144 having the parameters as at the point 108 is combined with a vapor stream S146 having parameters as at a point 109, forming a combined vapor-liquid mixed stream S148 having parameters as at a point 110. A composition of the stream S146 has an even higher concentration of the low boiling component than the rich working fluid stream S124 having the parameters as at the point 300. The stream S148 having the parameters as at the point 110 then enters into a separator S10, where it is separated into saturated vapor stream S150 having parameters as at a point 111, and saturated liquid stream S152 having parameters as at a point 112. The liquid stream S152 having parameters as at point 112 is then divided into two substreams S154 and S156 having parameters as at points 113 and 114, respectively.

Thereafter, the stream S156 having the parameters as at the point 114 is combined with the vapor stream S150 having the parameters as at the point 111, forming the stream S106 having the parameters as at the point 95, which has a composition equal or close to the composition of rich working fluid stream S124 having the parameters as at the point 300. The stream S106 having the parameters as at the point 95 is then sent into the first heat exchanger HE11, where it is fully condensed, forming the stream S110 having the parameters as at the point 98, and provides heat for the first heat exchange process as described above.

The liquid stream S154 having the parameters as at the point 113 enters into a second circulating pump P11, where it is pumped to a pressure sufficient to lift it to a top of a scrubber SC2, which is a direct contact heat/mass exchanger, forming a stream S158 having parameters as at a point 105. Upon reaching to the top of the scrubber SC2, stream S158 having the parameters as at the point 105 obtains parameters as at a point 102, and then enters the top of the scrubber SC2. The lean vapor stream S142 having the parameters as at the point 207 as describe above, enters a lower site of the scrubber SC2. As a result of mass and heat transfer between streams S158 and S142 having the parameters as at the point 102 and 207, respectively, a hot and lean liquid stream S160 having parameters as at a point 103 is collected at a bottom of the scrubber SC2. Meanwhile, the cooled and rich vapor stream S146 having the parameters as at the point 109, is formed at a upper site of the scrubber SC2. The liquid stream S160 having the parameters as at the point 103 is in a state of saturated liquid which is close to equilibrium with the vapor stream S142 having the parameters as at the point 207, whereas the vapor stream S146 having the parameters as at the point 109 is in a state of a saturated vapor close to equilibrium with the liquid stream S158 having the parameters as at the point 102. The vapor stream S146 having the parameters as at the point 109 is combined with the stream S144 having the parameters as at the point 108, forming the stream S148 having the parameters as at the point 110 as described above.

The liquid stream S160 having the parameters as at the point 103 enters into a second circulating pump P12, where it is pumped to a necessary high pressure, forming a stream S162 having parameters as at a point 203. The composition of the liquid streams S160 and S162 at the points 103 and 203 are substantially leaner than the lean working fluid streams S140, S120, S144 and S142.

Figure 3:
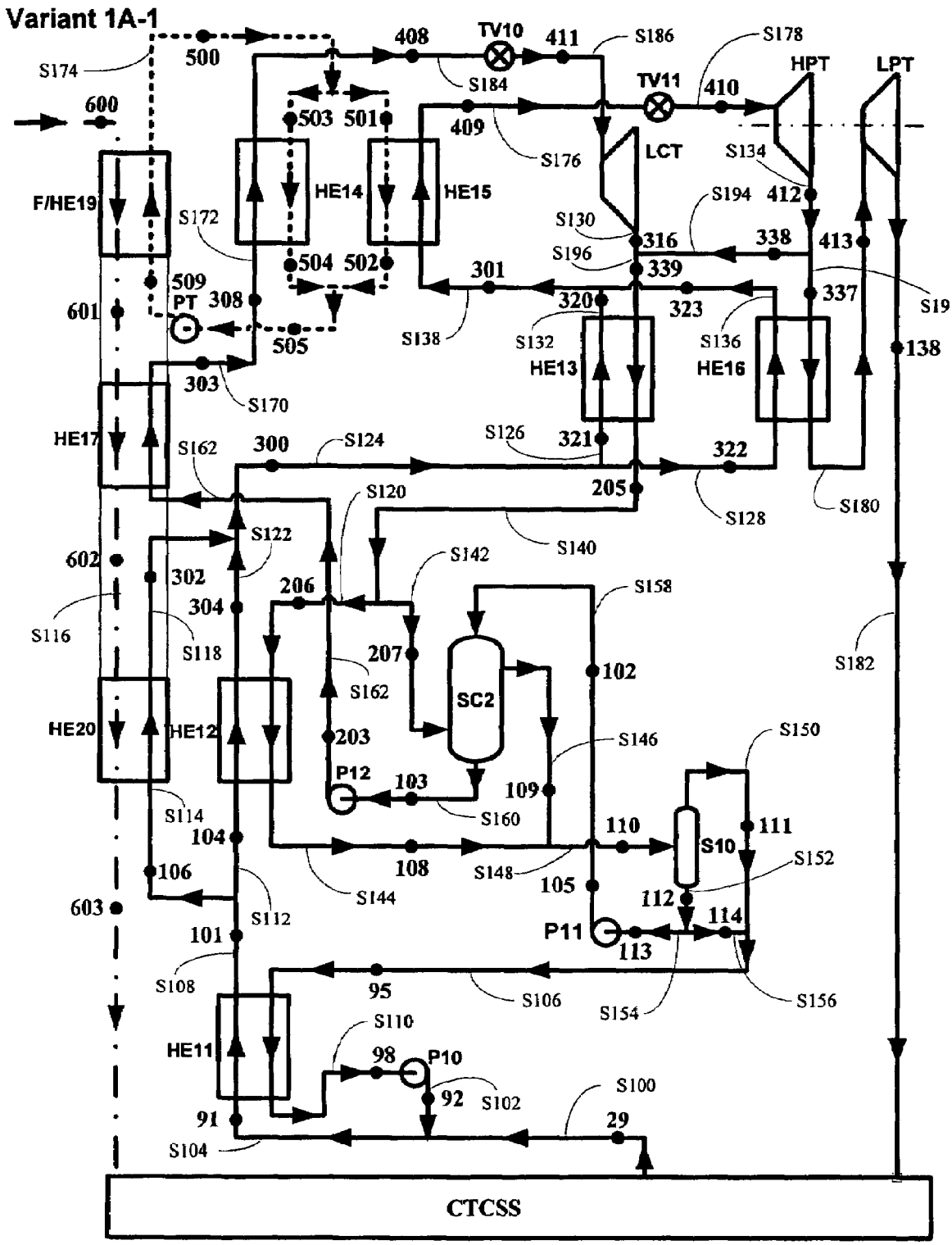
FIG. 3 depicts a block diagram of another preferred embodiment, Variant 1*a*1, of a cascade power system of this invention.

The rich working fluid stream S138 having the parameters as at the point 301 as described above, is then separated into two substreams S164 and S166 having parameters as at points 307 and 309, respectively. The weight flow rate of the stream S166 at point 309 is equal to the weight flow rate of rich working fluids stream S100 entering the system at the point 29 from the CTCSS, whereas the flow rate of the stream S164 at point 307 is equal to the weight flow rate of the stream S106 at the point 95. Alternatively, as shown in FIG. 3 illustrating Variant 1*a*1, the stream S138 having the parameters as at the point 301 is not split into two substreams and instead all of stream S138 is vaporized and forwarded to the throttle control valve TV11. To correct the composition of the stream S130 having parameters as at the point 316, the stream S134 having parameters as at the point 412 is split into two substreams S192 and S194 having parameters as at points 337 and 338, respectively. The stream S192 is forwarded to the heat exchanger HE16 emerging as the stream S180 having the parameters as at the point 413. The stream S194 having the parameters as at the point 338 is then mixed with the stream S130 having the parameters as at the point 316 forming a stream S196 having parameters as at a point 339 which is then forwarded to the heat exchanger HE13 energy as the stream S126 having the parameters as at the point 321.

The stream S164 having the parameters as at the point 307 passes through a third throttle valve TV12, forming a stream S168 having parameters as at a point 306. The subcooled liquid stream S162 having the parameters as at the point 203 as describe above, passes through a seventh heat exchanger HE17, where it is heated and fully vaporized in counterflow in a seventh heat exchange process by the stream S116 of flue gas having initial parameter as at the point 601 and final parameters as at the point 602 as described below, forming a stream S170 having parameters as at a point 303, corresponding, or close to, a state of saturated vapor, where close to means that the parameters of the stream are within about 5% of being in a state of saturated vapor.

Thereafter, the stream S170 having the parameters as at the point 303 is combined with the stream S168 having the parameters as at the point 306, forming a stream S172 having parameters as at a point 308. The composition and mass flow rate of stream S172 at the point 308 is the same as the composition and mass flow rate of stream S140 at the point 205 as described above, where the composition comprises the lean working fluid.

The rich working fluid stream S166 having the parameters as at the point 309 passes through a fifth heat exchanger HE15, where it is heated in counterflow in a fifth heat exchange step by a stream S174*a* of a high temperature heat transfer agent having initial parameters as at a point 501 and final parameters as at a point 502 as described below, forming a stream S176 having parameters as at point a 409. Thereafter, the stream S176 having the parameters as at the point 409 passes through an admission valve TV11, forming a rich working fluid stream S178 having parameters as at a point 410, and enters into a high pressure turbine HPT, where it expands, producing power, and becomes the stream S134 having the parameters as at the point 412. Thereafter, the stream S134 having the parameters as at the point 412 passes through the sixth heat exchanger HE16, where it is cooled, releasing heat in the sixth heat exchange process, forming a stream S180 having parameters as at a point 413. The rich working fluid stream S180 having the parameters as at the point 413 enters into the low pressure turbine LPT, where it expands, producing power, and becomes a stream S182 having parameters as at a point 138. The stream S182 having parameters as at point 138, which in the preferred embodiment shall be in, or close to a state of saturated vapor and is then sent into the CTCSS.

The lean working fluid stream S172 having the parameters as at the point 308 passes through a fourth heat exchanger HE14, where it is heated in counterflow in a fourth heat exchange process by a stream S174*b* of the high temperature heat transfer agent having initial parameters as at a point 503 and final parameters as at a point 504 as described below, forming a stream S184 having parameters as at a point 408. The stream S184 having the parameters as at the point 408 passes through a second admission valve TV10, forming a lean working fluid stream S186 having parameters as at a point 411, and enters into the low concentration working solution turbine LCT as described above, where it is expanded, producing power, and becomes the stream S130 having the parameters as at the point 316. The stream S130 having the parameters as at the point 316 then passes through the third heat exchanger HE13, where it is cooled, releasing heat for the third heat exchange process, forming the stream S140 having the parameters as at the point 205 as describe above.

If a pressure of the low-concentration working fluid stream S186 having the parameters as at the point 411 at an inlet to the low concentration working fluid turbine LCT as described above, is equal to a pressure of the rich working fluid stream S178 having the parameters as at the point 410 at an inlet to the high pressure turbine HPT, then the pressure of stream 307 does not change when it passes through the third throttle valve TV12, and thus the parameters of the stream S168 at the point 306 are the same as the parameters of the stream S164 at the point 307.

The acquisition of heat by the system of this invention occurs mostly in the superheater heat exchangers HE14 and HE15, where the working fluid is superheated. In the process of superheating, the film heat transfer coefficient inside the heat exchanger tubes is relatively low, and as a result, if these tubes were to be directly exposed to hot flue gas, then they would be overheated and would suffer severe damage. Therefore, a heat transfer process from the stream S116 of flue gas to the stream S174 of the high temperature heat transfer agent is implemented. Thus, the stream S174 of hot flue gas from the combustion zone or combustion reactor, having initial parameters as at a point 600 passes through a furnace heat exchanger or eighth heat exchanger F/HE19, where it is cooled, and obtains final parameters as at the point 601, transferring heat to the stream S174 of the high temperature heat transfer agent having initial parameters as at a point 509 and final parameters as at a point 500 as described below. Thereafter, the stream S174 having the parameters as at the point 500 is divided into the two substreams S174*a* and S174*b* having parameters as at the points 501 and 503, respectively.

The high temperature heat transfer agent can be liquid metals, molten salts, or other well known substances. In the tables that follow, the high temperature heat transfer agent is referred to as THERM.

After the streams S174*b* and S174*a* transfer heat in the fourth and fifth heat exchangers HE14 and HE15 to the streams S166 and S172, the streams S174*a* and S174*b* having the parameters as at the points 502 and 504 are combined, reforming the stream S174 having parameters as at a point 505. The stream S174 having the parameters as at the point 505 enters into a therm circulating pump PT, where it is pumped to an increased pressure sufficient to provide for a desired circulation rate of the high temperature heat transfer agent, changing the parameters of the stream S174 to the parameters as at the point 509.

The stream S116 of flue gas having the parameters as at the point 601 exiting from the furnace heat exchanger F/HE19 as described above, has been cooled to a moderate temperature, and is used further to transfer heat to the stream S162 and S114 in the seventh and fourth heat exchange processes in heat exchangers HE17 and HE20 as described above. The stream S116 of flue gas may be further cooled in a CTCSS that is more complex than a simple condenser, providing more complete utilization of available heat from the flue gas stream S116.

A flow diagram of a simple condenser for use in the system of this invention is shown in FIG. 2, and operates as follows. The rich working fluid stream S182 having the parameters as at the point 138 passes through a Condenser, where it is cooled and fully condensed in counterflow with a stream S188 of cooling water or air having initial parameters as at a point 51 at an inlet of the Condenser and final parameters as at a point 52 at an outlet of the Condenser, forming a stream S190 having parameters as at a point 27, corresponding to a state of saturated liquid. Thereafter, the fully condensed, rich working fluid stream S190 having the parameters as at the point 27 is pumped by a feed pump PF, to a required high pressure, forming the stream S100 having the parameters as the point 29, which is sent back into the system.

The inventor has performed computations for Variant 1*a*, where hot air was used as the heat source, instead of flue gas. This was done for purposes of generalization because flue gas may have different compositions in different systems. One experienced in the art can easily substitute flue gas for air in the computations. For the purposes of these computations, the specific heat capacity of the high temperature, heat transfer agent, THERM has been set equal to 1. Substituting the actual heat capacity of any specific high temperature, heat transfer agent would change only a weight flow rate of the agent in the high temperature fluid subsystem. One experienced in the art can easily make and calculate such a substitution.

The parameters of all key points of the Variant 1*a* of the system of this invention, with a simple condenser, are presented in Table 1.

TABLE 1

Parameters of the Streams associated with Key Operating Points

| Pt. | X lb/lb | T ° F. | P psia | H Btu/lb | S Btu/lb-R | G rel G/G = 1 | Ph. | Wetness or T lb/lb or ° F. |
|---|---|---|---|---|---|---|---|---|
| | | | | Working Fluid | | | | |
| 27 | 0.8300 | 65.80 | 98.823 | −17.0503 | 0.0497 | 1.00000 | Mix | 1 |
| 28 | 0.8300 | 71.82 | 1,900.000 | −6.6035 | 0.0549 | 1.00000 | Liq | −255.73° F. |
| 29 | 0.8300 | 71.82 | 1,900.000 | −6.6035 | 0.0549 | 1.00000 | Liq | −255.73° F. |
| 91 | 0.8300 | 141.45 | 1,900.000 | 73.1694 | 0.1958 | 1.82982 | Liq | −186.1° F. |
| 92 | 0.8300 | 220.46 | 1,900.000 | 169.3026 | 0.3460 | 0.82982 | Liq | −107.1° F. |
| 95 | 0.8300 | 348.73 | 732.429 | 734.9088 | 1.1336 | 0.82982 | Mix | 0.0207 |
| 98 | 0.8300 | 213.54 | 730.429 | 161.7429 | 0.3438 | 0.82982 | Mix | 1 |
| 101 | 0.8300 | 326.73 | 1,890.000 | 333.0983 | 0.5685 | 1.82982 | Mix | 1 |
| 102 | 0.3506 | 348.73 | 734.429 | 261.4583 | 0.5117 | 0.71068 | Liq | −0.34° F. |
| 103 | 0.1658 | 429.15 | 735.429 | 377.8855 | 0.6235 | 0.72008 | Mix | 1 |
| 104 | 0.8300 | 326.73 | 1,890.000 | 333.0983 | 0.5685 | 1.58780 | Mix | 1 |
| 105 | 0.3506 | 348.92 | 764.429 | 261.7082 | 0.5119 | 0.71068 | Liq | −5° F. |
| 106 | 0.8300 | 326.73 | 1,890.000 | 333.0983 | 0.5685 | 0.24202 | Mix | 1 |
| 108 | 0.5214 | 335.73 | 732.429 | 381.3522 | 0.6725 | 1.02270 | Mix | 0.714 |
| 109 | 0.7815 | 369.42 | 734.429 | 783.3991 | 1.1881 | 0.51780 | Mix | 0 |
| 110 | 0.6088 | 348.73 | 732.429 | 516.4913 | 0.8467 | 1.54050 | Mix | 0.4725 |
| 111 | 0.8401 | 348.73 | 732.429 | 744.9260 | 1.1468 | 0.81263 | Mix | 0 |
| 112 | 0.3506 | 348.73 | 732.429 | 261.4587 | 0.5117 | 0.72788 | Mix | 1 |
| 113 | 0.3506 | 348.73 | 732.429 | 261.4583 | 0.5117 | 0.71068 | Mix | 1 |
| 114 | 0.3506 | 348.73 | 732.429 | 261.4583 | 0.5117 | 0.01719 | Mix | 1 |
| 117 | 0.8300 | 0.00 | 14.693 | 0.0000 | 0.0000 | 0.00000 | Mix | 0 |

TABLE 1-continued

Parameters of the Streams associated with Key Operating Points

| Pt. | X lb/lb | T ° F. | P psia | H Btu/lb | S Btu/lb-R | G rel G/G = 1 | Ph. | Wetness or T lb/lb or ° F. |
|---|---|---|---|---|---|---|---|---|
| 129 | 0.8300 | 71.82 | 1,900.000 | −6.6035 | 0.0549 | 1.00000 | Liq | −255.73° F. |
| 138 | 0.8300 | 228.51 | 100.823 | 733.8930 | 1.3382 | 1.00000 | Mix | 0 |
| 203 | 0.1658 | 433.73 | 1,880.000 | 383.5250 | 0.6248 | 0.72008 | Liq | −121.56° F. |
| 205 | 0.5214 | 431.15 | 735.429 | 933.1136 | 1.3205 | 1.54990 | Mix | 0 |
| 206 | 0.5214 | 431.15 | 735.429 | 933.1136 | 1.3205 | 1.02270 | Mix | 0 |
| 207 | 0.5214 | 431.15 | 735.429 | 933.1136 | 1.3205 | 0.52720 | Mix | 0 |
| 300 | 0.8300 | 413.15 | 1,885.000 | 688.4858 | 0.9996 | 1.82982 | Mix | 0 |
| 301 | 0.8300 | 805.05 | 1,870.000 | 1,042.1481 | 1.3416 | 1.82982 | Vap | 392.2° F. |
| 302 | 0.8300 | 413.15 | 1,885.000 | 688.4858 | 0.9996 | 0.24202 | Mix | 0 |
| 303 | 0.1658 | 595.47 | 1,870.000 | 1,065.4074 | 1.2954 | 0.72008 | Mix | 0 |
| 304 | 0.8300 | 413.15 | 1,885.000 | 688.4858 | 0.9996 | 1.58780 | Mix | 0 |
| 306 | 0.8300 | 805.05 | 1,870.000 | 1,042.1481 | 1.3416 | 0.82982 | Vap | 392.2° F. |
| 307 | 0.8300 | 805.05 | 1,870.000 | 1,042.1481 | 1.3416 | 0.82982 | Vap | 392.2° F. |
| 308 | 0.5214 | 677.54 | 1,870.000 | 1,052.9544 | 1.3522 | 1.54990 | Vap | 160.6° F. |
| 309 | 0.8300 | 805.05 | 1,870.000 | 1,042.1481 | 1.3416 | 1.00000 | Vap | 392.2° F. |
| 316 | 0.5214 | 841.33 | 742.429 | 1,216.8921 | 1.5835 | 1.54990 | Vap | 409.3° F. |
| 320 | 0.8300 | 823.33 | 1,870.000 | 1,056.0742 | 1.3525 | 1.19652 | Vap | 410.5° F. |
| 321 | 0.8300 | 413.15 | 1,885.000 | 688.4858 | 0.9996 | 1.19652 | Mix | 0 |
| 322 | 0.8300 | 413.15 | 1,885.000 | 688.4858 | 0.9996 | 0.63329 | Mix | 0 |
| 323 | 0.8300 | 770.56 | 1,870.000 | 1,015.8366 | 1.3205 | 0.63329 | Vap | 357.7° F. |
| 408 | 0.5214 | 1,051.47 | 1,850.000 | 1,333.8795 | 1.5676 | 1.54990 | Vap | 535.4° F. |
| 409 | 0.8300 | 1,050.96 | 1,850.000 | 1,231.5125 | 1.4796 | 1.00000 | Vap | 638.6° F. |
| 410 | 0.8300 | 1,050.00 | 1,800.000 | 1,231.5125 | 1.4826 | 1.00000 | Vap | 638.9° F. |
| 411 | 0.5214 | 1,050.00 | 1,800.000 | 1,333.8795 | 1.5706 | 1.54990 | Vap | 536.4° F. |
| 412 | 0.8300 | 788.56 | 512.867 | 1,063.5002 | 1.5021 | 1.00000 | Vap | 460.6° F. |
| 413 | 0.8300 | 476.33 | 505.867 | 856.1914 | 1.3128 | 1.00000 | Vap | 149.3° F. |
| | | | | Heat Source | | | | |
| 500 | THERM | 1,075.00 | 14.693 | 1,043.0000 | 1.0990 | 1.94210 | Liq | |
| 501 | THERM | 1,075.00 | 14.693 | 1,043.0000 | 1.0990 | 0.77309 | Liq | |
| 502 | THERM | 830.05 | 14.693 | 798.0544 | 0.9251 | 0.77309 | Liq | |
| 503 | THERM | 1,075.00 | 14.693 | 1,043.0000 | 1.0990 | 1.16901 | Liq | |
| 504 | THERM | 702.54 | 14.693 | 670.5431 | 0.8210 | 1.16901 | Liq | |
| 505 | THERM | 753.30 | 14.693 | 721.3013 | 0.8637 | 1.94210 | Liq | |
| 509 | THERM | 753.30 | 14.693 | 721.3013 | 0.8637 | 1.94210 | Liq | |
| 600 | AIR | 1,742.00 | 13.193 | 466.2399 | 0.8560 | 3.27620 | Vap | 2056.2° F. |
| 601 | AIR | 1,045.33 | 13.121 | 275.5404 | 0.7524 | 3.27620 | Vap | 1359.6° F. |
| 602 | AIR | 458.73 | 13.049 | 125.6680 | 0.6270 | 3.27620 | Vap | 773.1° F. |
| 603 | AIR | 351.73 | 12.976 | 99.4151 | 0.5970 | 3.27620 | Vap | 666.2° F. |
| 638 | AIR | 351.73 | 12.976 | 99.4151 | 0.5970 | 3.27620 | Vap | 666.2° F. |
| 639 | AIR | 351.73 | 12.976 | 99.4151 | 0.5970 | 3.27620 | Vap | 666.2° F. |
| | | | | Coolant | | | | |
| 51 | water | 51.80 | 68.773 | 20.0769 | 0.0396 | 14.1078 | Liq | −249.93° F. |
| 52 | water | 105.08 | 58.773 | 73.3057 | 0.1387 | 14.1078 | Liq | −186.27° F. |

Figure 4:
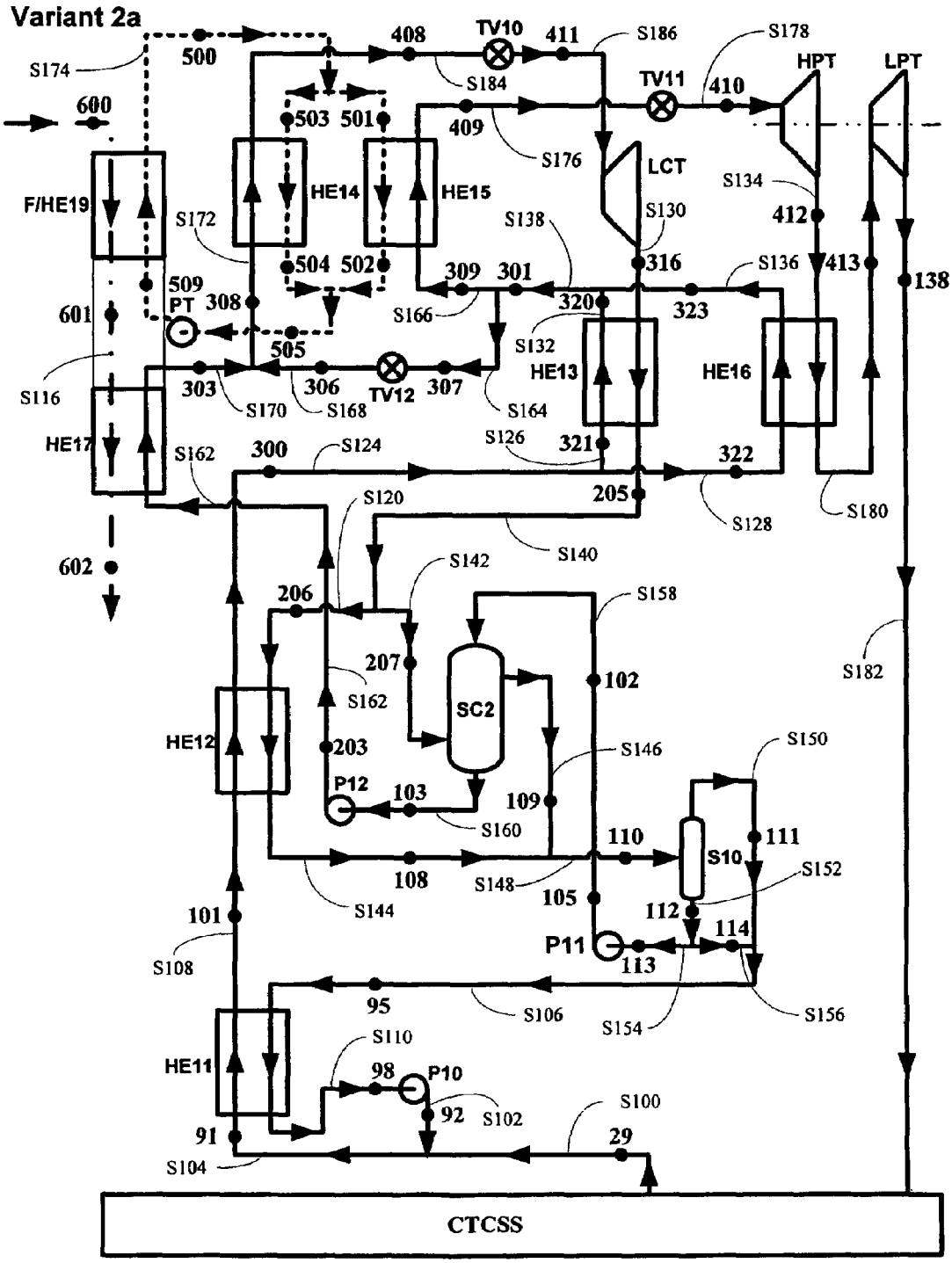
FIG. 4 depicts a block diagram of another preferred embodiment, Variant 2*a*, of a cascade power system of this invention.
Figure 5:
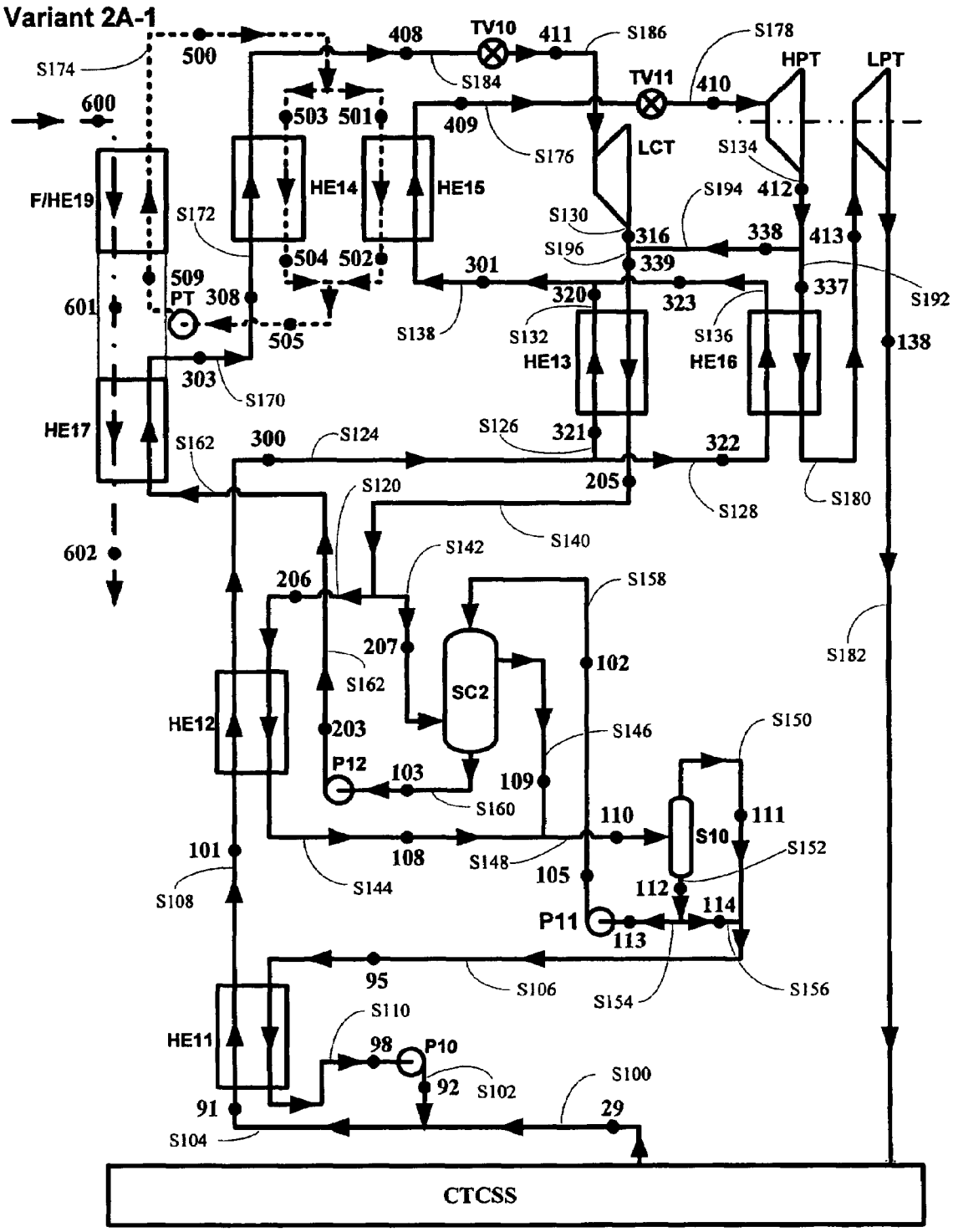
FIG. 5 depicts a block diagram of another preferred embodiment, Variant 2*a*1, of a cascade power system of this invention.

In the system of this invention, as described above, the flue gas which is the heat source used to generated usable energy is cooled to a relatively low temperature. This cooling is possible only in the case where such flue gas is not corrosive, as in the case of biomass combustion or clean coal combustion. But in a case where the flue gas is corrosive, as in the case of municipal waste incineration, etc., it can be cooled only to a relatively high temperature. In the case, where the flue gas can only be cooled to a relatively high temperature, the ninth heat exchanger HE20 is excluded from the system, and the stream S116 of flue gas having the parameters as at the point 602 is sent to a stack. The variant of the system of this invention in which the ninth heat exchanger HE20 is excluded is referred to as Variant 2*a* and is shown in FIG. 4. It is evident that is this case, the entire stream S108 having the parameters as at the point 101 is sent into the second heat exchanger HE12, forming directly the stream S124 having the parameters as at the point 300. Alternatively, as shown in FIG. 5 illustrating Variant 1*a*1, the stream S138 having the parameters as at the point 301 is not split into two substreams and instead all of stream S138 is vaporized and forwarded to the throttle control valve TV11. To correct the composition of the stream S130 having parameters as at the point 316, the stream S134 having parameters as at the point 412 is split into two substreams S192 and S194 having parameters as at points 337 and 338, respectively. The stream S192 is forwarded to the heat exchanger HE16 emerging as the stream S180 having the parameters as at the point 413. The stream S194 having the parameters as at the point 338 is then mixed with the stream S130 having the parameters as at the point 316 forming a stream S196 having parameters as at a point 339 which is then forwarded to the heat exchanger HE13 emergy as the stream S126 having the parameters as at the point 321.

Figure 6:
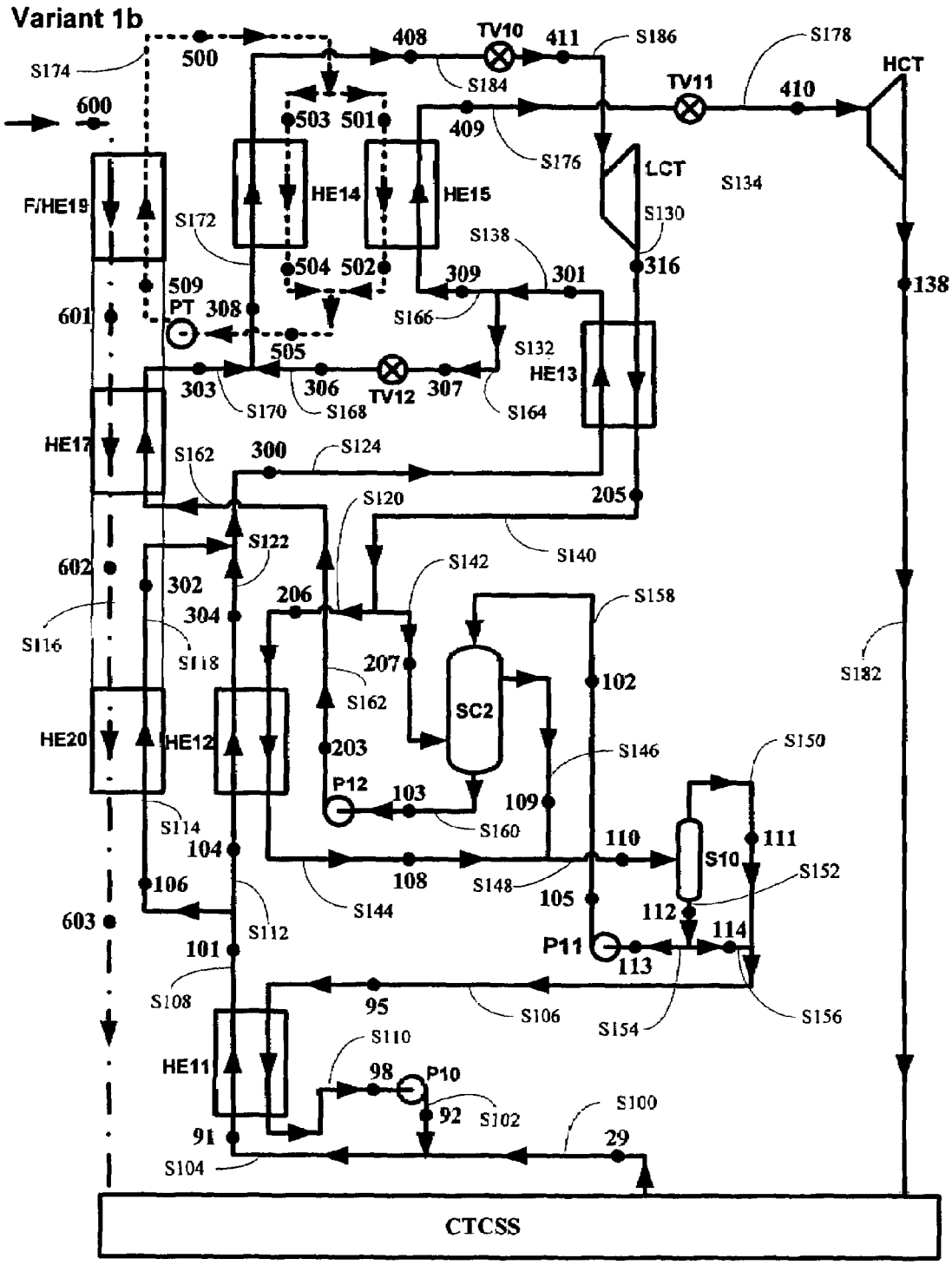
FIG. 6 depicts a block diagram of another preferred embodiment, Variant 1*b*, of a cascade power system of this invention.
Figure 7:
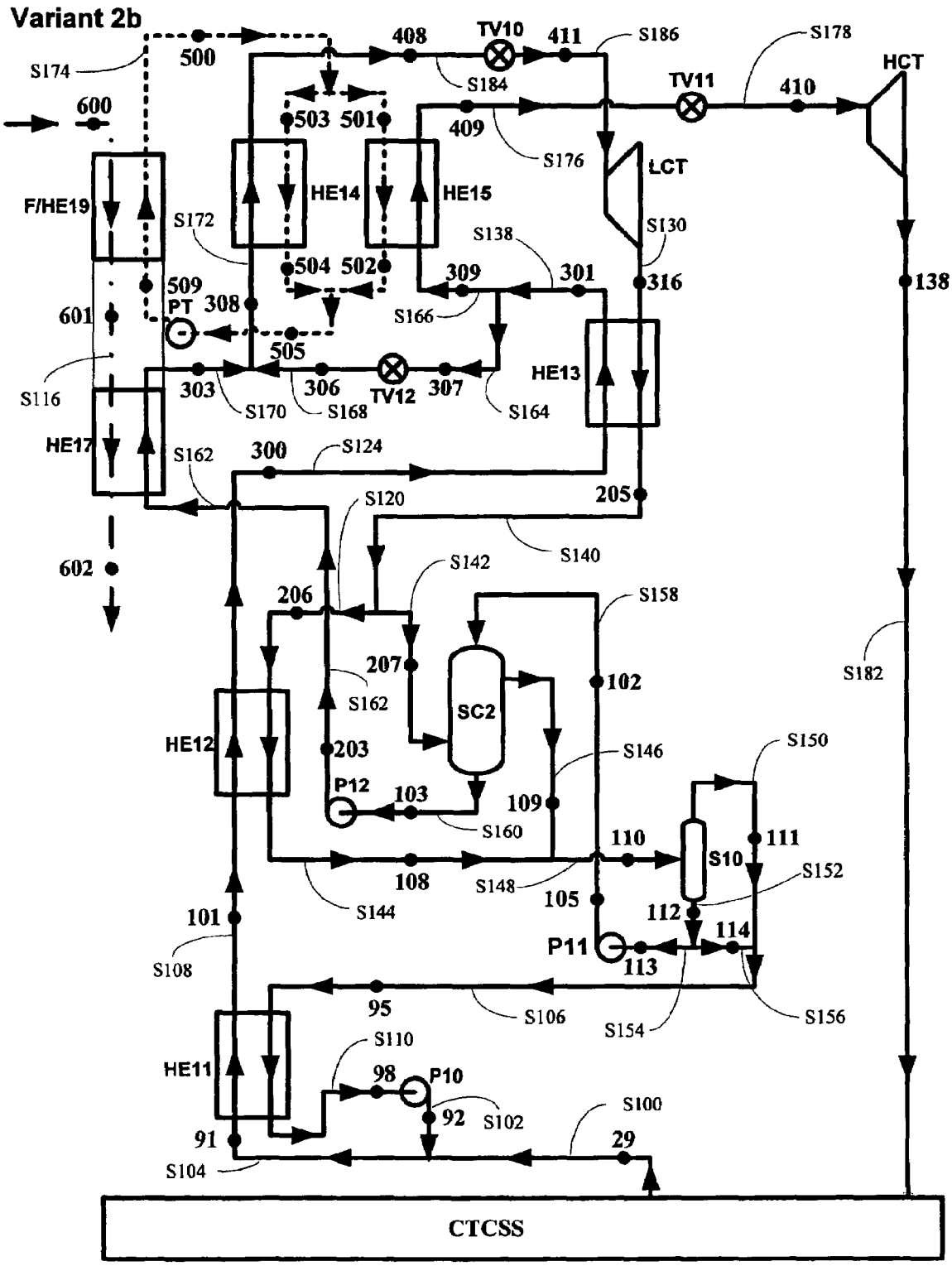
FIG. 7 depicts a block diagram of another preferred embodiment, Variant 2*b*, of a cascade power system of this invention.

Both Variants 1*a* and Variants 2*a* can be simplified by excluding the intercooler or the sixth heat exchanger HE16. Such a simplification results in a reduction in an efficiency of the system of this invention to an extent which will be demonstrated below. This simplified variant of the system (with the intercooler HE16 excluded) when applied to Variant 1*a* shall be referred to as Variant 1*b*, and is shown in FIG. 6. The analogous simplification of Variant 2*a* is shown in FIG. 7 and is referred to as Variant 2*b*. For the Variants 1*b* and Variants 2*b*, the two stage turbine subsystem for the high concentration or rich working fluid stream S178 is replaced by a single high concentration working fluid turbine HCT, and the stream of rich working fluid stream S182 having the parameters as at the point 138 exiting the high concentration working fluid turbine HCT will be in a state of superheated vapor.

Figure 8:
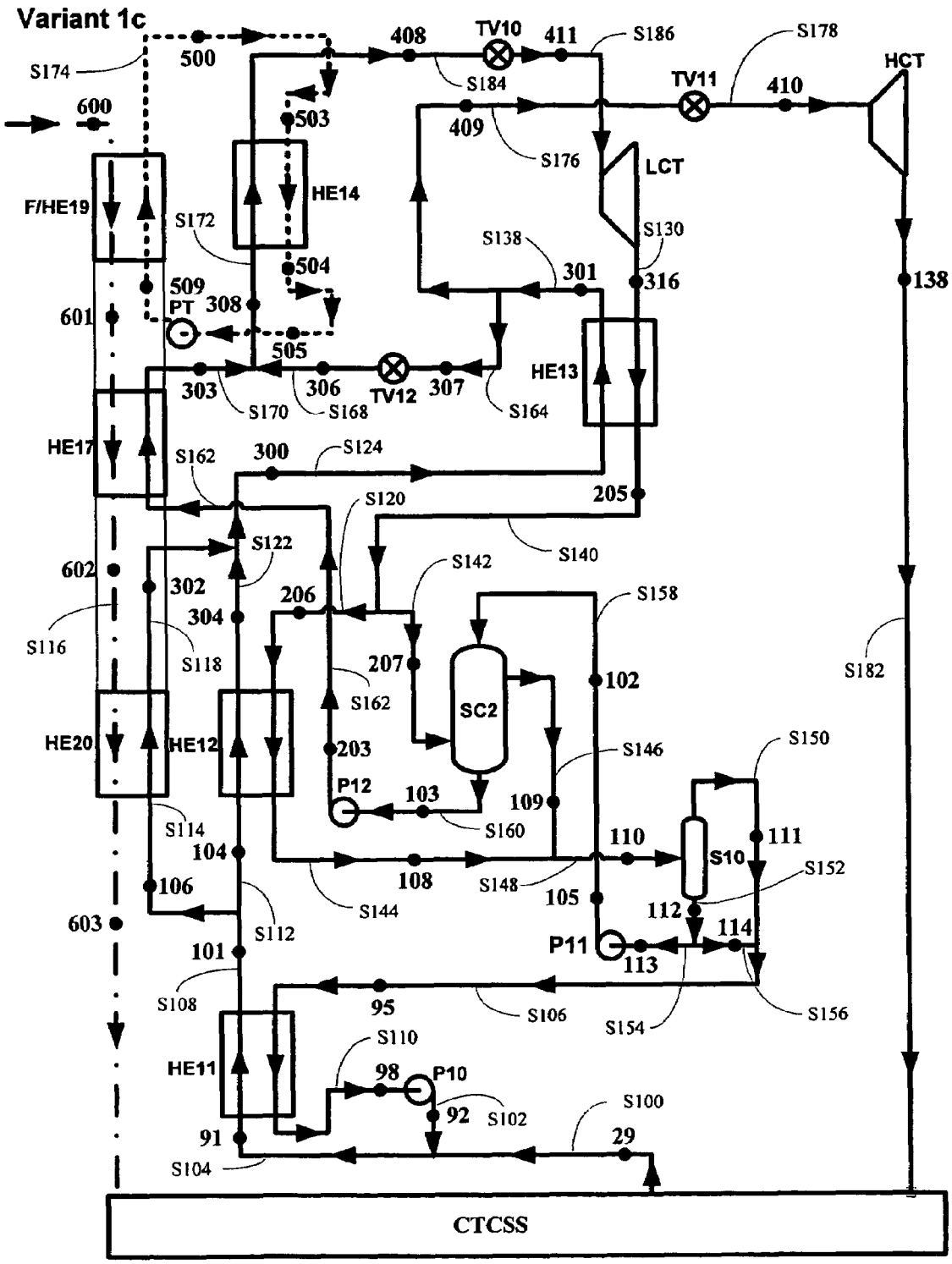
FIG. 8 depicts a block diagram of another preferred embodiment, Variant 1*c*, of a cascade power system of this invention.
Figure 9:
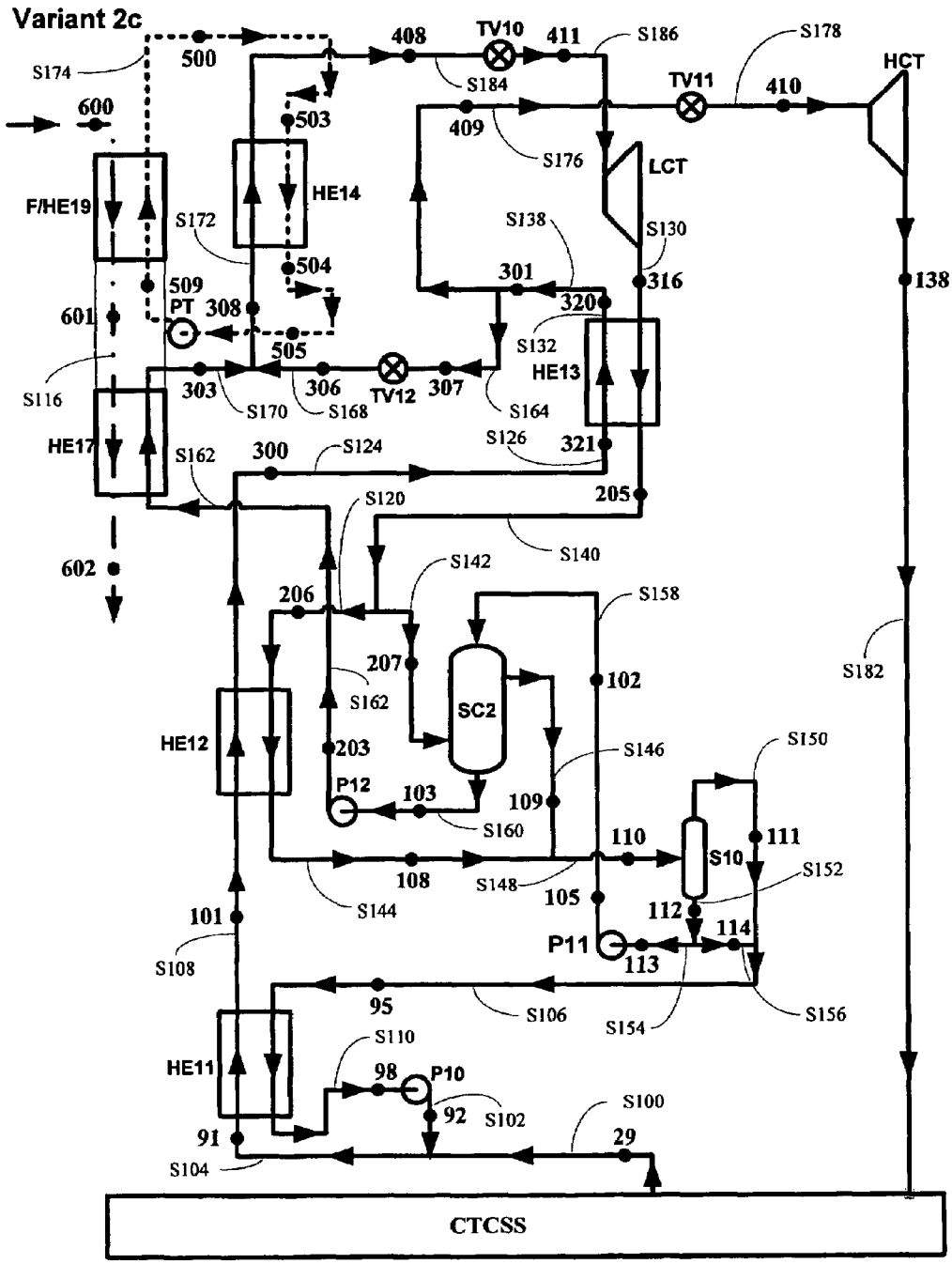
FIG. 9 depicts a block diagram of another preferred embodiment, Variant 2*c*, of a cascade power system of this invention.

Both Variants 1*b* and Variants 2*b* may be further simplified by excluding the superheater or fifth heat exchanger HE15. In these cases, the rich working fluid stream S166 having the parameters as at the point 309 is superheated only recuperatively, and is then sent directly into the high pressure turbine HPT. This simplification also results in a reduced efficiency in the system of this invention. Such simplified variants of the system excluding the superheater HE15, shall be designated as Variant 1*c* when applied to the Variant 1*b*, as shown in FIG. 8. The analogous simplification of Variant 2*b* is referred to as Variant 2*c* as shown in FIG. 9. It should be clear that Variants 2*a*, Variants 2*b* and Variants 2*c* can be used not only in cases where the flue gas must not be cooled to too low a temperature, but also as simplifications of Variants 1*a*, Variants 1*b* and Variants 1*c*, respectively.

Usually, in Variants 1*a*, Variants 2*a*, Variants 1*b* and Variants 2*b*, the temperatures of admission into high pressure turbine HPT or the high concentration working fluid turbine HCT and low concentration working stream turbine LCT are the same, or very close, where very close means that the temperatures are within about 2.5% of each other. If these temperatures are high enough, then the pressure at the turbine inlet of the low concentration working fluid stream LCT for the lean working fluid stream S186 having the parameters as at the point 411 is the same as the pressure at the turbine inlet to HPT or HCT for the rich working fluid stream S178 having the parameters as at the point 410, and after expansion the lean working fluid stream S130 having the parameters as at the point 316 is in a state of superheated vapor and can be cooled in the third heat exchanger HE13. But if the temperature of admission is relatively low, then the state of the lean working fluid stream S130 having the parameters as at the point 316 could be a state of saturated or even wet vapor. However, for the operation of the second heat exchanger HE12 and the scrubber SC2, it is necessary that the temperature of the stream S130 at the point 316 is not lower than a required temperature of the stream S140 at the point 205. Therefore, in the case that the temperature of admission is too low, the inlet pressure for the low concentration working fluid turbine LCT must be lowered so that the temperature of the stream S130 at the point 316 would not be lower than a required temperature for the stream S140 at the point 205. In such a case, the pressures of the streams S162, S172, S140, and S184 at points 203, 308, 205 and 408 are correspondingly lowered and the stream S164 having the parameters as at the point 307, while passing through the third throttle valve TV12, has its pressure reduced so that the pressure of the stream S168 at point 306 is equal to the pressure of the stream S170 at point 303. It is evident that in this case, the third heat exchanger HE13 is not used and does not exist.

It is clear from the above that the lean working fluid stream S140 having the parameters as at the point 205, after partial condensation in the second heat exchanger HE12 and the heat and mass transfer process in the scrubber SC2, has been separated into two streams; a stream S106 of rich working fluid with a composition as at the point 95 and a streams S160 and S162 of lean liquid with a composition as at the points 103 and 203. Stream S106 having the parameters as at the point 95 was then combined with a stream S100 having the parameters as at the point 29 of rich working fluid entering into the system from the CTCSS, and then was fully vaporized together with the rich working fluid stream S114 in the ninth heat exchanger HE20 and the rich working fluid stream S112 in the second heat exchanger HE12. As a result, a substantial portion of the initial stream S140 having the parameters as at the point 205 has been re-vaporized at a high pressure by heat released by the partial condensation of the same stream S140 having the parameters as at the point 205 at low pressure. This is an important aspect of the system of this invention.

The system of this invention, as described above, includes two inlet streams, i.e., the stream S116 of flue gas having the parameters as at the point 600, and pressurized subcooled liquid stream S100 having the parameters as at the point 29. The system also includes two outlet streams, i.e., the cooled stream S116 of flue gas having the parameters as at the point 603 in the case of Variants 1*a* and 1*b*, and the stream S116 having the parameters as at the point 602 in the case of Variant 2*a* and Variant 2*b*. The system of this invention also includes a rich working fluid vapor stream S182 having the parameters as at the point 138, which has been expanded in the low pressure turbine LPT portion of the rich working turbine assembly, i.e., the high pressure turbine and the low pressure turbine in Variants 1*a* and 2*a* and the high concentration working fluid turbine LCT of Variants 1*b*&*c* and 2*b*&*c*.

The stream S182 having the parameters as at the point 138 must be condensed and then pumped to a pressure equal to that of the stream S100 at point 29. The simplest way to do so is to pass the stream S182 having the parameters 138 through a condenser cooled by outside water or air as described above. The relative performances of six variants of the system of this invention as described above, operating with a simple condenser as shown in FIG. 2, at ambient ISO conditions (the temperature of air is 59° F.; relative humidity of the air is 60% at sea level), are shown in Table 2. In Table 2, the Variant 1*b* of this invention is shown as having a net output of 10,000 kW. For all other variants, the same heat source is assumed.

The performance and efficiency of the system of this invention can be significantly increased if it is combined with a CTCSS in place of the simple condenser as described above. The use of an CTCSS allows for the pressure of condensation, and correspondingly the pressure of the stream S182 having the parameters as at the point 138, to be substantially lower than is possible using a simple condenser. This will increase the power output of the low pressure turbine LPT and the efficiency of the system as a whole. Therefore, in alternate embodiments of the system of this invention, the stream S182 having the parameters as at the point 138 is sent into a one of several variants of a condensation thermal compression subsystem (CTCSS) where it can be condensed at a pressure significantly lower than the required pressure of condensation of the rich composition working fluid at an ambient temperature, resulting in increased efficiency.

In a previous application devoted specifically to different variants of the CTCSS, 5 basic variants of CTCSS were described. Each variant of the CTCSS could be embodied in two subvariants, a & b; with (a), and without (b), preheating of the condensed working fluid. For the proposed system, variants of the CTCSS without preheating of the working fluid are preferred.

For the Variant 1*a-c* of the system this invention, all five variants of the CTCSS can be used. Since Variant 2*a-c* of the system the present invention do not allow for cooling of the flue gas to a low temperature, only Variants 3-5 of the CTCSS can be used with Variant 2*a-c* of the system this invention.

The relative performance, at ISO conditions, of Variant 1*a* and Variant 1*b* and Variant 2*a* and Variant 2*b* of the system of this invention, assuming the same heat source and using a simple condenser to condense the stream S182 to form the stream S100 are tabulated in Table 2. The relative performance, at ISO conditions, of Variant 1*a* and Variant 1*b* and Variant 2*a* and Variant 2*b* with different variants of the CTCSS without preheating as described above are tabulated in Table 3.

TABLE 2

Power Efficiency Data for Variants 1a-c and 2a-c Using a Simple Condenser

| System | Net output kW | Thermal efficiency % | Utilization of heat source LHV % | LHV efficiency % | Incremental output % | Pressure at point 138 psia |
|---|---|---|---|---|---|---|
| Variant 1a | 10698.28 | 35.625 | 83.822 | 29.861 | 6.983 | 100.823 |
| Variant 1b | 10000.00 | 33.305 | 83.821 | 27.913 | 0.0 | 100.823 |
| Variant 1c | 9955.93 | 33.118 | 83.912 | 27.790 | −0.441 | 100.823 |
| Variant 2a | 9922.94 | 35.678 | 77.633 | 27.698 | −0.771 | 100.823 |
| Variant 2b | 9517.60 | 34.222 | 77.631 | 26.566 | −4.824 | 100.823 |
| Variant 2c | 9507.26 | 34.184 | 77.631 | 26.537 | −4.927 | 100.823 |

TABLE 3

Power Efficiency Data for Variants 1a-b and 2a-b Using a Different CTCSS Variants

| System | Net output kW | Thermal efficiency % | Utilization of heat source LHV % | LHV efficiency % | Incremental output % | Pressure at point 138 psia |
|---|---|---|---|---|---|---|
| Variant 1a CTCSS 5b | 11208.88 | 37.326 | 83.822 | 31.287 | 12.089 | 73.526 |
| Variant 1a CTCSS 4b | 11618.05 | 38.689 | 83.822 | 32.430 | 16.181 | 54.382 |
| Variant 1a CTCSS 3b | 11721.75 | 39.035 | 83.820 | 32.719 | 17.218 | 50.416 |
| Variant 1a CTCSS 2b | 11866.93 | 26.282 | 91.292 | 33.123 | 18.669 | 44.600 |
| Variant 1a CTCSS 1b | 11977.69 | 38.530 | 91.522 | 33.433 | 19.777 | 40.842 |
| Variant 1b CTCSS 5b | 10871.47 | 36.203 | 83.821 | 30.346 | 8.751 | 59.368 |
| Variant 1b CTCSS 4b | 11235.70 | 37.416 | 83.821 | 31.362 | 12.357 | 45.079 |
| Variant 1b CTCSS 3b | 11335.75 | 37.749 | 83.821 | 31.641 | 12.358 | 42.067 |
| Variant 1b CTCSS 2b | 11430.25 | 35.020 | 91.105 | 31.905 | 14.303 | 38.972 |
| Variant 1b CTCSS 1b | 11550.80 | 35.294 | 91.105 | 32.242 | 15.508 | 35.772 |
| Variant 2a CTCSS 5b | 10470.85 | 37.645 | 77.633 | 29.227 | 4.709 | 73.526 |
| Variant 2a CTCSS 4b | 10899.85 | 39.188 | 77.637 | 30.425 | 8.999 | 54.382 |
| Variant 2a CTCSS 3b | 11006.77 | 39.537 | 77.637 | 30.723 | 10.068 | 50.416 |
| Variant 2b CTCSS 5b | 10313.04 | 37.082 | 77.631 | 28.787 | 3.130 | 59.368 |
| Variant 2b CTCSS 4b | 10647.78 | 38.283 | 77.635 | 29.721 | 6.478 | 45.079 |
| Variant 2b CTCSS 3b | 10739.09 | 38.611 | 77.635 | 29.976 | 7.391 | 42.067 |

In sum, the system of this invention consists of 6 variants. In combination with a simple condenser and various variants of the CTCSS, there are 30 possible embodiments and combinations of the power system of this invention. One experienced in the art will be able to select the variant and combination of the system of this invention and a simple condenser or a CTCSS such as will suit any given economic and technical conditions.

Current state of the art biomass power plants have an LHV efficiency not exceeding 20%. In contrast, the most simple and least efficient variant of the system of this invention, Variant 2*c* using a simple condenser, has an LHV efficiency of 26.537%; i.e., 1.327 time higher tan the state of the art biomass power plants operated to date. The most efficient variant of the system of this invention, Variant 1*a* with Variant 1*b* of the CTCSS has an LHV efficiency of 33.433%; i.e., 1.672 times higher than the current state of the art.

CTCSS Variant 1*a*

Referring now to FIG. 2, a preferred embodiment of a CTCSS of this invention, generally 190, is shown and is referred to herein as CTCSS Variant 1*a*. CTCSS Variant 1*a* represents a very comprehensive variant of the CTCSSs of this invention.

The operation of CTCSS Variant 1*a* of the CTCSS of this invention is now described.

A stream S182 having parameters as at a point 138, which can be in a state of superheated vapor or in a state of saturated or slightly wet vapor, enters into the CTCSS 200. The stream S182 having the parameters as at the point 138 is mixed with a first mixed stream S202 having parameters as at a point 71, which is in a state of a liquid-vapor mixture (as describe more fully herein), forming a first combined stream S204 having parameters as at a point 38. If the stream S182 having the parameters as at the point 138 is in a state of saturated vapor, then a temperature of the stream S202 having the parameters as at the point 71 must be chosen in such a way as to correspond to a state of saturated vapor. As a result, the stream S204 having the parameters as at the point 38 will be in a state of a slightly wet vapor. Alternatively, if the stream S182 having the parameters as at the point 138 is in a state of superheated vapor, then stream S202 having the parameters of at the point 71 must be chosen in such a way that the resulting stream S204 having the parameters as at a point 38 should be in, or close to, a state of saturated vapor, where close to means the state of the vapor is within 5% of the saturated vapor state for the vapor. In all cases, the parameters of the stream S202 at the point 71 are chosen in such a way as to maximize a temperature of the stream S204 at the point 38.

Thereafter, the stream S204 having the parameters as at the point 38 passes through a first heat exchanger HE1, where it is cooled and partially condensed and releases heat in a first heat exchange process, producing a second mixed stream S206 having parameters as at a point 15. The stream S206 having the parameters as at the point 15 is then mixed with a stream S208 having parameters as at a point 8, forming a stream S210 having parameters as at a point 16. In the preferred embodiment of this system, the temperatures of the streams S208, S206 and S210 having parameters of the points 8, 15, and 16, respectively, are equal or very close, within about 5%. A concentration of the low-boiling component in stream S208 having the parameters as at the point 8 is substantially lower than a concentration of the low boiling component in the stream S206 having the parameters as at the point 15. As a result, a concentration of the low boiling component in the stream S210 having the parameters as at the point 16 is lower than the concentration of the low boiling component of the stream S206 having the parameters as at the point 15, i.e., stream S210 having the parameters as at the point 16 is leaner than stream S206 having the parameters as at the point 15.

The stream S210 having the parameters as at the point 16 then passes through a second heat exchanger HE2, where it is further condensed and releasing heat in a second heat exchange process, forming a stream S212 having parameters as at a point 17. The stream S212 having the parameters as at the point 17 then passes through a third heat exchanger HE3, where it is further condensed in a third heat exchange process to form a stream S214 having parameters as at a point 18. At the point 18, the stream S214 is partially condensed, but its composition, while substantially leaner that the compositions of the stream S182 and S204 having the parameters as at the points 138 and 38, is such that it cannot be fully condensed at ambient temperature. The stream S214 having the parameters as at the point 18 is then mixed with a stream S216 having parameters as at a point 41, forming a stream S218 having parameters as at a point 19. The composition of the stream S218 having the parameters as at the point 19 is such that it can be fully condensed at ambient temperature.

The stream S218 having the parameters as at the point 19 then passes through a low pressure condenser HE4, where it is cooled in a fourth heat exchange process in counterflow with a stream S220 of cooling water or cooling air having initial parameters as at a point 51 and final parameters as at a point 52, becoming fully condensed, to form a stream S222 having parameters as at a point 1. The composition of the stream S222 having the parameters as at the point 1, referred to herein as the "basic solution," is substantially leaner than the composition of the stream S182 having the parameters at the point 138, which entered the CTCSS 100. Therefore, the stream S222 having the parameters as at the point 1 must be distilled at an elevated pressure in order to produce a stream S182 having the same composition as at point 138, but at an elevated pressure that will allow the stream to fully condense.

The stream S222 having the parameters as at the point 1 is then divided into two substreams S224 and S226 having parameters as at points 2 and 4, respectively. The stream S224 having the parameters as at the point 2 enters into a circulating fourth pump P4, where it is pumped to an elevated pressure forming a stream S228 having parameters as at a point 44, which correspond to a state of subcooled liquid. Thereafter, the stream S228 having the parameters as at the point 44 passes through a third heat exchanger HE3 in counterflow with the stream S212 having the parameters as at the point 17 in a third heat exchange process as described above, is heated forming a stream S230 having parameters as at a point 14. The stream S230 having the parameters as at the point 14 is in, or close to, a state of saturated liquid. Again, the term close to means that the state of the stream S230 is within 5% of being a saturated liquid. Thereafter, the stream S230 having parameters as at point 14 is divided into two substreams S232 and S234 having parameters as at points 13 and 22, respectively. The stream S234 having the parameters as at the point 22 is then divided into two substreams S236 and S238 having parameters as at points 12 and 21, respectively. The stream S236 having the parameters as at the point 12 then passes through the second heat exchanger HE2, where it is heated and partially vaporized in counterflow to the stream S200 having the parameters as at the point 16 as described above in a second heat exchange process, forming a stream S240 having parameters as at a point 11. The stream S240 having the parameters as at the point 11 then passes through the first heat exchanger HE1, where it is further heated and vaporized in counterflow to the stream S204 having stream 38 as described above in a first heat exchange process, forming a stream S242 having parameters as at a point 5.

The stream S242 having the parameters as at the point 5, which is in a state of a vapor-liquid mixture, enters into a first separator S1, where it is separated into a saturated vapor stream S244 having parameters as at a point 6 and saturated liquid stream S246 having parameters as at a point 7.

The liquid stream S246 having the parameters as at the point 7 is divided into two substreams S248 and S250 having parameters as at points 70 and 72, respectively. The stream S248 having the parameters as at the point 70, then passes through an eighth heat exchanger HE8, where it is heated and partially vaporized in an eighth heat exchange process, in counterflow to an external heat carrier stream S252 having initial parameters as a point 638 and final parameters as at a pint 639, forming a stream S254 having parameters as at a point 74. Thereafter, stream S254 having the parameters as at the point 74 passes through a fifth throttle valve TV5, where its pressure is reduced to a pressure equal to a pressure of the stream S182 having the parameters as at the point 138, forming the stream S202 having the parameters as at the point 71. Thereafter, the stream S202 having the parameters as at the point 71 is mixed with the stream S182 having the parameters as at the point 138, forming the stream S204 having the parameters as at the point 38 as previously described.

The stream S250 having parameters as at point 72, then passes through a first throttle valve TV1, where its pressure is reduced, forming a stream S256 having parameters as at a point 73. The pressure of the stream S256 having the parameters as at the point 73 is equal to a pressure of the streams S206, S208, and S210 having the parameters as at the points 15, 8 and 16. Thereafter the stream S256 having the parameters as at the point 73 is mixed with a stream S258 having parameters as at a point 45, forming the stream S208 having the parameters as at the point 8. The stream S208 having the parameters as a the point 8 is then mixed with the stream S206 having the parameters as at the point 15, forming the stream S210 having the parameters as at the point 16 as described above.

Meanwhile, the vapor stream S244 having the parameters as at the point 6 is sent into a bottom part of a first scrubber SC1, which is in essence a direct contact heat and mass exchanger. At the same time, the stream S238 having the parameters as at the point 21 as described above, is sent into a top portion of the first scrubber SC1. As a result of heat and mass transfer in the first scrubber SC1, a liquid stream S260 having parameters as at a point 35, which is in a state close to equilibrium (close means within about 5% of the parameters of the stream S244) with the vapor stream S244 having the parameters as at the point 6, is produced and removed from a bottom of the first scrubber SC1. At the same time, a vapor stream S262 having parameters as at point 30, which is in a state close to equilibrium with the liquid stream S238 having the parameters as at the point 21, exits from a top of the scrubber SC1.

The vapor stream S262 having the parameters as at the point 30 is then sent into a fifth heat exchanger HE5, where it is cooled and partially condensed, in counterflow with a stream S264 of working fluid having parameters as at a point 28 in a fifth heat exchange process, forming a stream S266 having parameters as at a point 25.

The liquid stream S260 having the parameters as at the point 35 is removed from the bottom of the scrubber SC1 and is sent through a fourth throttle valve TV4, where its pressure is reduced to a pressure equal to the pressure of the stream S256 having the parameters as at the point 73, forming the stream S258 having the parameters as at the point 45. The stream S258 having the parameters as at the point 45 is then mixed with the stream S256 having the parameters as at the point 73, forming the stream S208 having the parameters as at the point 8 as described above.

The liquid stream S232 having the parameters as at the point 13, which has been preheated in the third heat exchanger HE3 as described above, passes through a second throttle valve TV2, where its pressure is reduced to an intermediate pressure, (i.e., a pressure which is lower than the pressure of the stream S230 having the parameter as at the point 14, but higher than the pressure of the stream S222 having the parameters as at the point 1), forming a stream S268 parameters as at a point 43, corresponding to a state of a vapor-liquid mixture. Thereafter, the stream S268 having the parameters as at the point 43 is sent into a third separator S3, where it is separated into a vapor stream S270 having parameters as at a point 34 and a liquid stream S272 having parameters as at a point 32.

A concentration of the low boiling component in the vapor stream S270 having the parameters as at the point 34 is substantially higher than a concentration of the low boiling component in the stream S182 having the parameters as at the point 138 as it enters the CTCSS 200 as described above. The liquid stream S272 having the parameters as at the point 32 has a concentration of low boiling component which is less than a concentration of low boiling component in the stream S222 having the parameters as at the point 1 as described above.

The liquid stream S226 of the basic solution having the parameters as at the point 4 as described above, enters into a first circulating pump P1, where it is pumped to a pressure equal to the pressure of the stream S270 having the parameters as at the point 34, forming a stream S274 having parameters as at a point 31 corresponding to a state of subcooled liquid. Thereafter, the subcooled liquid stream S274 having the parameters as at the point 31 and the saturated vapor stream S270 having the parameters as at the point 34 are combined, forming a stream S276 having parameters as at a point 3. The stream S276 having the parameters as at the point 3 is then sent into an intermediate pressure condenser or a seventh heat exchanger HE7, where it is cooled and fully condensed in a seventh heat exchange process, in counterflow with a stream S278 of cooling water or air having initial parameters as at a point 55 and having final parameters as at a point 56, forming a stream S280 having parameters as at a point 23. The stream S280 having parameters as at point 23 then enters into a second circulating pump P2, where its pressure is increased to a pressure equal to that of the stream S266 having the parameters as at the point 25 as described above, forming a stream S282 parameters as at a point 40. The stream S282 having the parameters as at the point 40 is then mixed with the stream S266 having the parameters as at the point 25 as described above, forming a stream S284 having parameters as at a point 26. The composition and flow rate of the stream S282 having the parameters as at the point 40 are such that the stream S284 having the parameters as at the point 26 has the same composition and flow rate as the stream S182 having the parameters as at the point 138, which entered the CTCSS 100, but has a substantially higher pressure.

Thereafter, the stream S284 having the parameters as at the point 26 enters into a high pressure condenser or sixth heat exchanger HE6, where it is cooled and fully condensed in a sixth heat exchange process, in counterflow with a stream S286 of cooling water or air having initial parameters as at a point 53 and final parameters as at a point 54, forming a steam S288 parameters as at a point 27, corresponding to a state of saturated liquid. The stream S288 having the parameters as at the point 27 then enters into a third or feed pump P3, where it is pumped to a desired high pressure, forming the stream S264 having the parameters as at the point 28. Then the stream S264 of working fluid having the parameters as at the point 28 is sent through the fifth heat exchanger HE5, where it is heated, in counterflow with the stream S262 having the parameters as at the point 30 in the fifth heat exchange process, forming a stream S100 having parameters as at a point 29 as described above. The stream S290 having the parameters as at a point 29 then exits the CTCSS 100, and returns to the power system. This CTCSS of this invention is closed in that no material is added to any stream in the CTCSS.

In some cases, preheating of the working fluid which is reproduced in the CTCSS is not necessary. In such cases, the fifth heat exchanger HE5 is excluded from the CTCSS Variant 1*a* described above. As a result, the stream S262 having the parameters as at the point 30 and the stream S266 having the parameters as at the point 25 are the same, and the stream S264 having the parameters at the point 28 are the stream S100 having the parameters as at the point 29 are the same as shown in FIG. 3. The CTCSS system in which HE5 is excluded is referred to as CTCSS Variant 1*b*.

The CTCSSs of this invention provide highly effective utilization of heat available from the condensing stream S182 of the working solution having the parameters as at the point 138 and of heat from external sources such as from the stream S252.

In distinction from an analogous system described in the prior art, the lean liquid stream S246 having the parameters as at the point 7 coming from the first separator S1, is not cooled in a separate heat exchanger, but rather a portion of the stream S246 is injected into the stream S200 of working fluid returning from the power system.

When the stream S236 of basic solution having the parameters as at the point 12 starts to boil, it initially requires a substantial quantity of heat, while at the same time its rise in temperature is relatively slow. This portion of the reboiling process occurs in the second heat exchanger HE2. In the process of further reboiling, the rate of increase in the temperatures becomes much faster. This further portion of the reboiling process occurs in the first heat exchanger HE1. At the same time, in the process of condensation of the stream S204 having the parameters as at the point 38, initially a relatively large quantity of heat is released, with a relatively slow reduction of temperature. But in further condensation, the rate of reduction of temperature is much higher. As a result of this phenomenon, in the prior art, the temperature differences between the condensing stream of working solution and the reboiling stream of basic solution are minimal at the beginning and end of the process, but are quite large in the middle of the process.

In contrast to the prior art, in the CTCSS of this invention, the concentration of the low boiling component in stream S208 having the parameters as at the point 8 is relatively low and therefore in the second heat exchanger HE2, stream S208 having the parameters as at the point 8 not only condenses itself, but has the ability to absorb additional vapor. As a result, the quantity of heat released in the second heat exchanger HE2 in the second heat exchange process is substantially larger than it would be if streams S208 and S206 having the parameters as at the points 8 and 15, respectively, were cooled separately and not collectively collect after combining the two stream S208 and S206 to form the stream S210. As a result, the quantity of heat available for the reboiling process comprising the first and second heat exchange processes is substantially increased, which in turn increases the efficiency of the CTCSS system.

The leaner the stream S208 having the parameters at as the point 8 is, the greater its ability to absorb vapor, and the greater the efficiency of the heat exchange processes occurring in the first and second heat exchangers HE1 and HE2. But the composition of the stream S208 having the parameters at as the point 8 is defined by the temperature of the stream S242 having the parameters as at the point 5; the higher the temperature of the stream S242 having the parameters as at the point 5, the leaner the composition of stream S208 having the parameters at as the point 8 can be.

It is for this reason that external heat derived from stream S252 is used to heat stream S248 having the parameters as at the point 70, thus raising the temperature of the stream S204 having the parameters as at the point 38, and as a result also raising the temperature of the stream S242 having the parameters as at the point 5. However, increasing of the temperature of the stream S242 having the parameters as at the point 5, and correspondingly the temperature of the stream S244 having the parameters as at a point 6, leads to a reduction in a concentration of the low boiling component in the vapor stream S244 having the parameters as at the point 6.

Use of the scrubber SC1, in place of a heat exchanger, for the utilization of heat from the stream S244 having the parameters as at the point 6 allows both the utilization of the heat from the stream S244 having the parameters as at the point 6 and an increase of the concentration of low boiling component in the produced vapor stream S262 having the parameters as at the point 30.

The vapor stream S262 having the parameters as at the point 30 has a concentration of low-boiling component which is higher than the concentration of the low boiling component in the vapor stream S244 having the parameters as at the point 6, and the flow rate of stream S262 having the parameters as at the point 30 is higher than the flow rate of the stream S244 having the parameters as at the point 6.

The concentration of low boiling component in the working fluid is restored in the stream S284 having the parameters at the point 26, by mixing the stream S266, a very rich solution, having the parameters as at the point 25 (or the stream S262 having the parameters as at the point 30, in the case of the CTCSS Variant 1*b*), with the stream S282 having the parameters as at the point 40. The stream S282 having the parameters as at point 40 has a higher concentration of low boiling component than the basic solution, (i.e., is enriched). Such an enrichment has been used in the prior art, but in the prior art, in order to obtain this enrichment, a special intermediate pressure reboiling process is needed requiring several additional heat exchangers.

In the CTCSSs of this invention, all heat that is available at a temperature below the boiling point of the basic solution (i.e., below the temperature of the stream S230 having the parameters as at the point 14) is utilized in a single heat exchanger, the third heat exchanger HE3. Thereafter, the vapor needed to produce the enriched stream S282 having the parameters as at the point 40 is obtained simply by throttling the stream S232 having the parameters as at the point 13.

The CTCSSs of this invention can be simplified by eliminating some "modular" components. For instance, it is possible to enrich the stream S282 having the parameters as at the point 40 without using the intermediate pressure condenser, the seventh heat exchanger HE7. Such a system, with preheating of the stream S264 of working fluid having the parameters as at the point 28 is shown in FIG. 3, and referred to as CTCSS Variant 2*a*. A similar system, but without preheating the stream S264 of working fluid having the parameters as at the point 28, is shown in FIG. 4, and referred to as CTCSS Variant 2*b*.

In the CTCSS Variant 2*a* and CTCSS Variant 2*b*, in distinction to the CTCSS Variant 1*a* and CTCSS Variant 1*b*, the pressure of the stream S268 having the parameters as at the point 43 is chosen in such a way that the when mixing the vapor stream S270 having the parameters as at the point 34 and the liquid stream S274 having the parameters as at the point 31, the subcooled liquid stream S274 having the parameters as at the point 31 fully absorbs the vapor stream S270 having the parameters as at the point 34, and the resulting stream S276 having the parameters as at the point 3 is in a state of saturated, or slightly subcooled, liquid. Thereafter, the liquid S276 having the parameters as at the point 3 is sent into the second pump P2, to form the stream S282 having the parameters as at the point 40, and is mixed with stream 25.

The simplification of the CTCSS of CTCSS Variant 2*a* and CTCSS Variant 2*b* reduces the overall efficiency of the CTCSSs of this invention, but at the same time, the cost is also reduced.

Another possible modular simplification of the CTCSS Variant 1*a* and CTCSS Variant 1*b* can be used in a case where external heat is not available, or the choice is made not to utilize external heat. Such a variant of the CTCSS of this invention, with preheating of the stream S264 of working fluid having the parameters as at the point 28 is shown in FIG. 5, and is referred to as CTCSS Variant 3*a*. A similar CTCSS of this invention, but without preheating the stream S264 of the working fluid having the parameters as at the point 28, is shown in FIG. 6, and referred to as CTCSS Variant 3*b*.

In CTCSS Variant 3*a* and CTCSS Variant 3*b*, the stream S248 having the parameters as at the point 70 is not heated, but rather simply passes through the fifth throttle valve TV5, to form the stream S202 having the parameters as at the point 71, and is then mixed with the stream S182 having the parameters as at the point 138, forming the stream S204 having the parameters as at the point 38. This mixing process is used only in a case where the stream S182 having the parameters as at the point 138 is in a state of superheated vapor. The flow rate of streams S248 and S202 having the parameters as at the points 70 and 71 is chosen in such a way that the stream S204 having the parameters as at the point 38 formed as a result of mixing the stream S202 having the parameters as at the point 71 and the stream S182 having the parameters as at the point 138 is in a state of saturated, or slightly wet, vapor.

It is also possible to simplify CTCSS Variant 2*a* and CTCSS Variant 2*b* in the same manner than CTCSS Variant 1*a* and CTCSS Variant 1*b* are simplified to obtain CTCSS Variant 3*a* and CTCSS Variant 3*b*. This modular simplification of CTCSS Variant 2*a* and CTCSS Variant 2*b*, with preheating of the stream S264 of the working fluid having the parameters as at the point 28 is shown in FIG. 7, and is referred to as CTCSS Variant 4*a*; while a similar simplification of CTCSS CTCSS Variant 2*b*, without preheating the stream S264 of the working fluid having the parameters as at the point 28, is shown in FIG. 8, and referred to as CTCSS Variant 4*b*.

Figure 10:
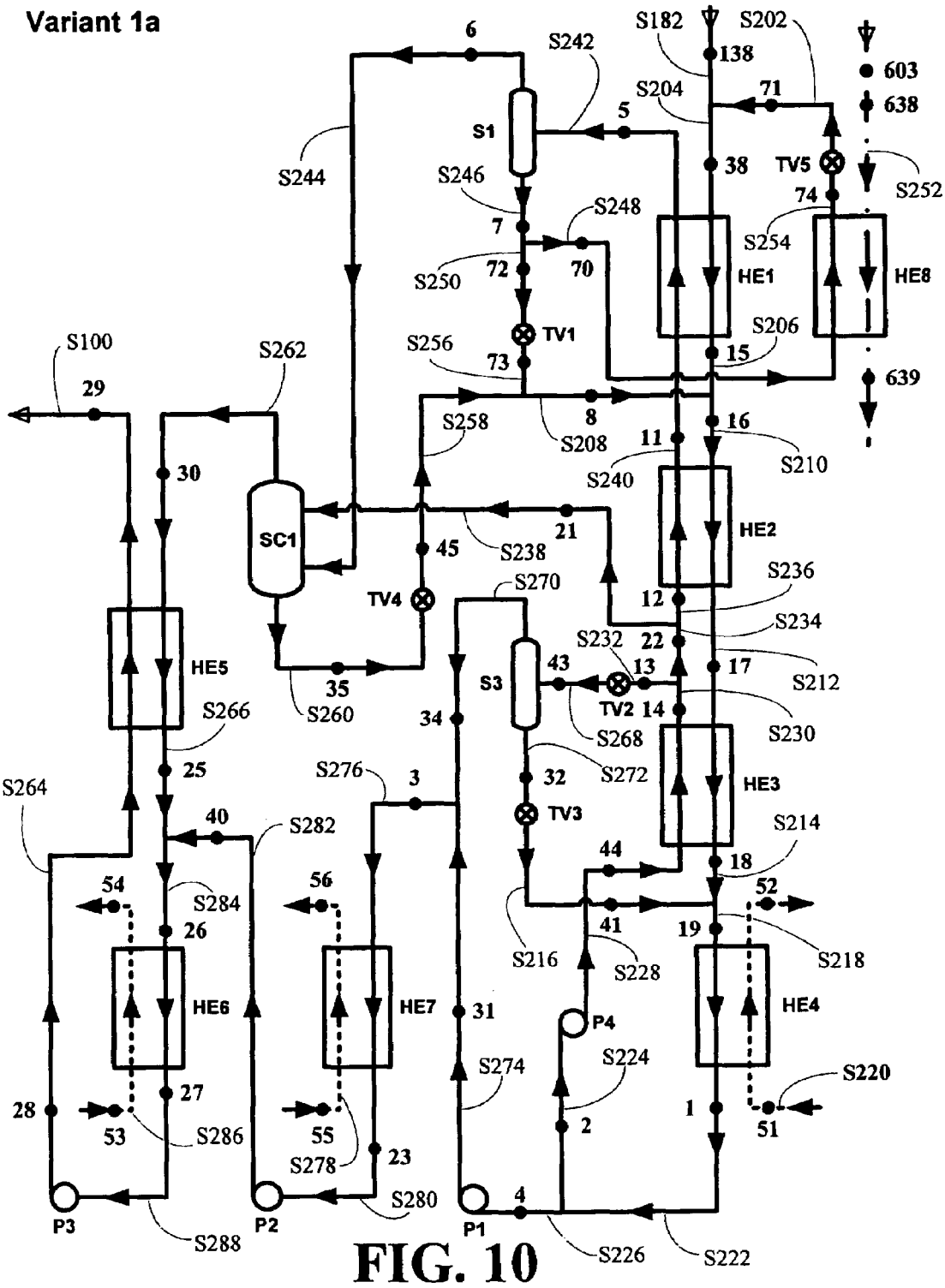
FIG. 10 depicts a block diagram of a preferred embodiment of CTCSS Variant 1*a* of a condensation and thermal compression subsystems.
Figure 11:
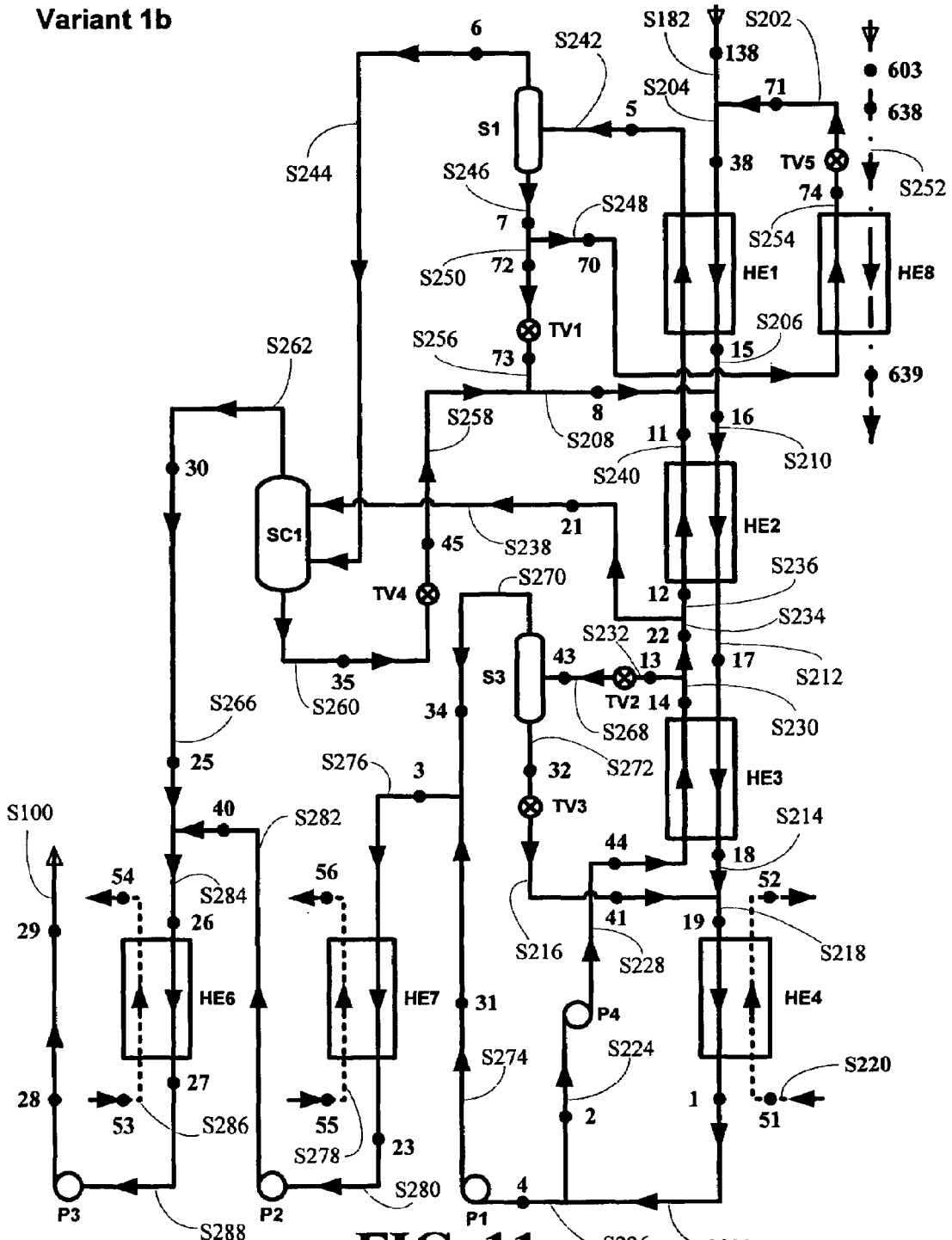
FIG. 11 depicts a block diagram of another preferred embodiment of CTCSS Variant 1*b* of a condensation and thermal compression subsystems.
Figure 12:
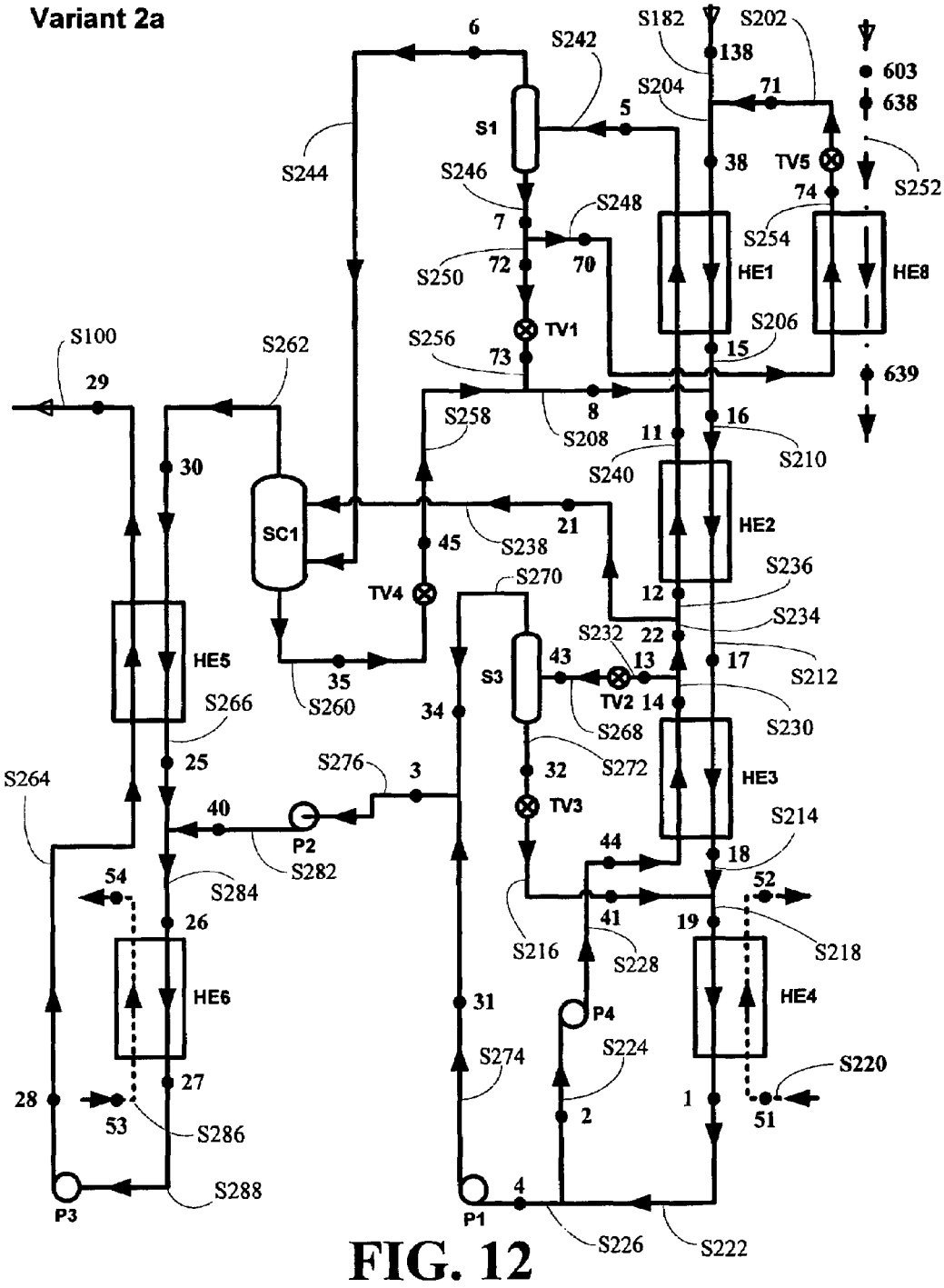
FIG. 12 depicts a block diagram of a preferred embodiment of CTCSS Variant 2*a* of a condensation and thermal compression subsystems.
Figure 13:
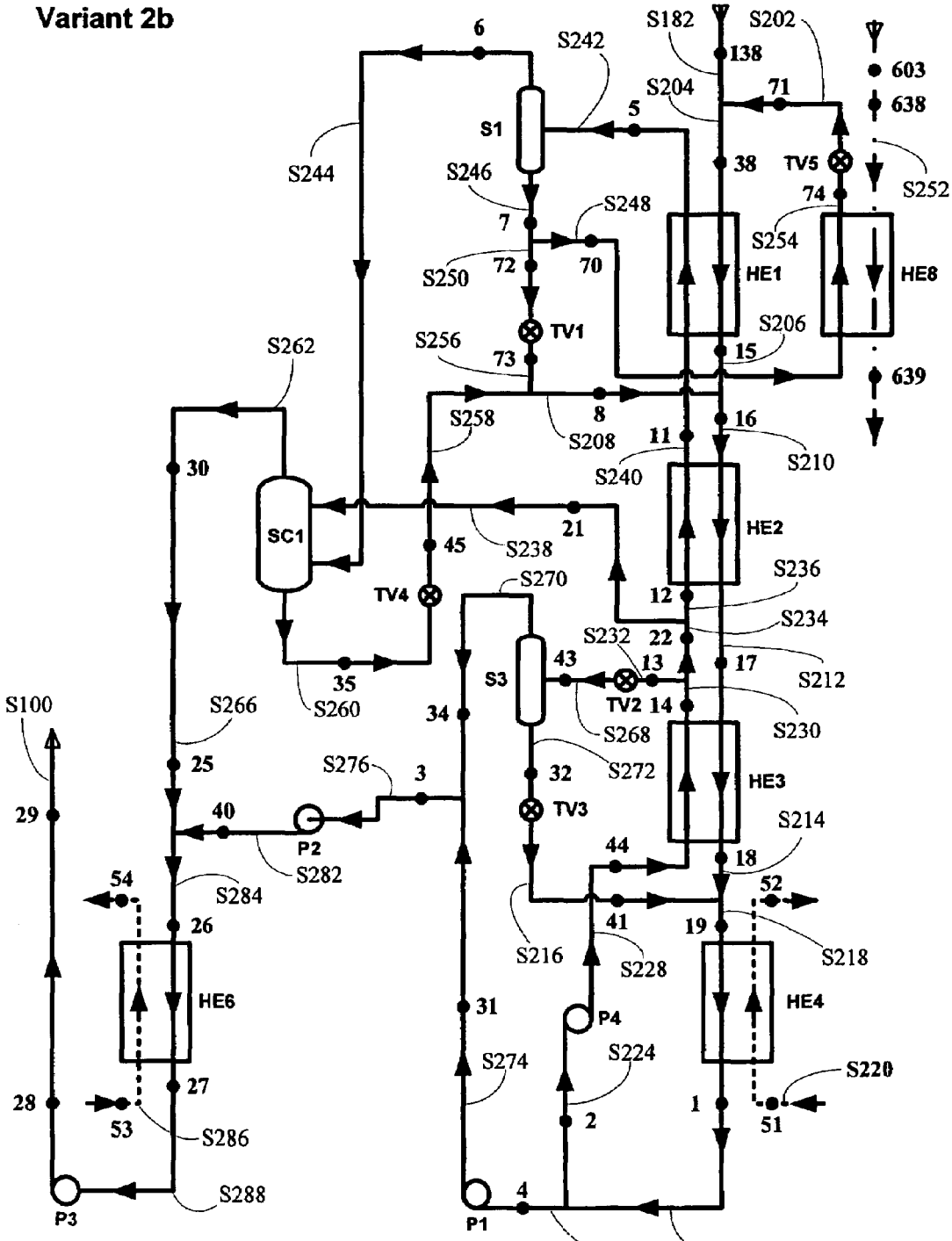
FIG. 13 depicts a block diagram of a preferred embodiment of CTCSS Variant 2*b* of a condensation and thermal compression subsystems.
Figure 14:
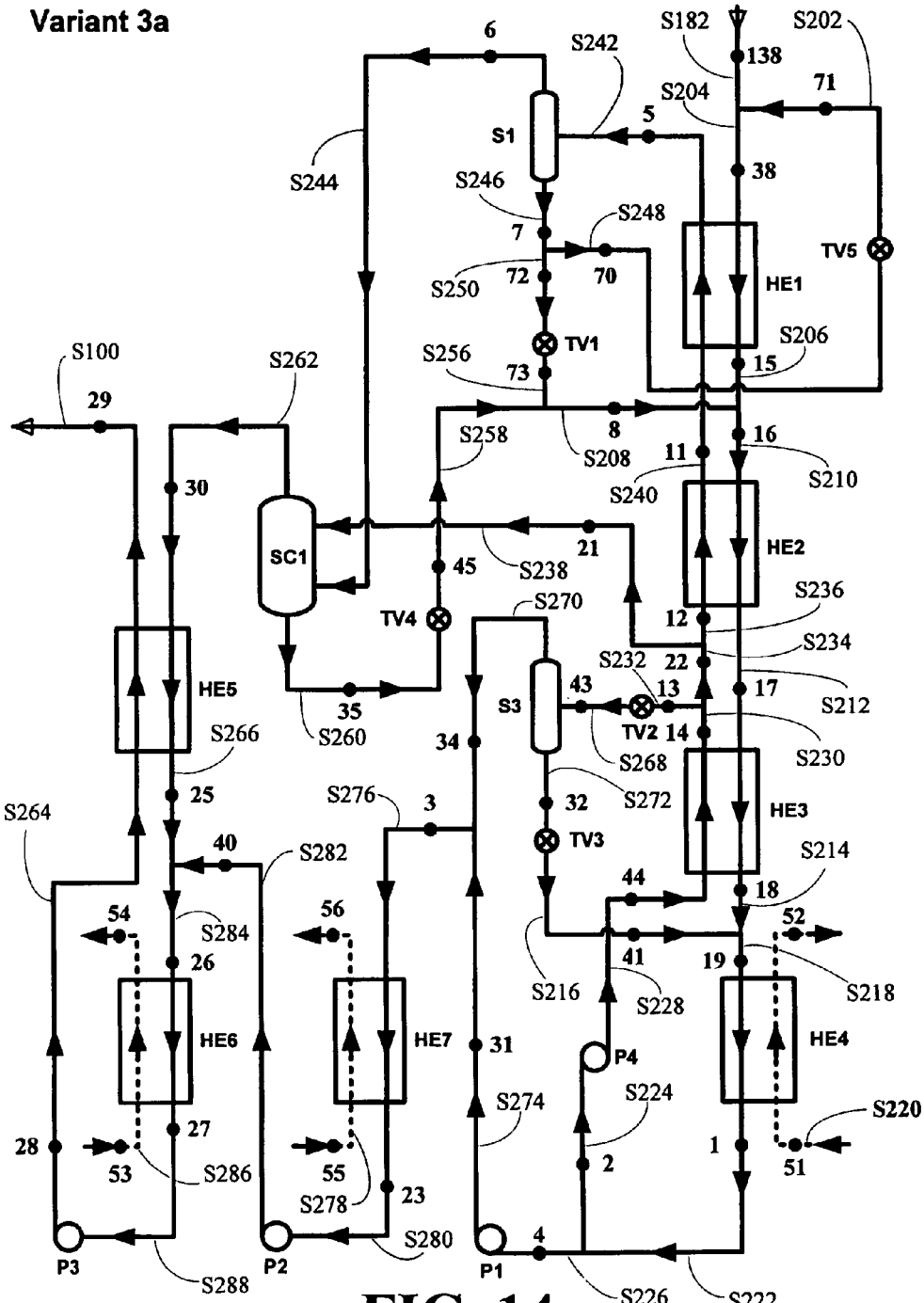
FIG. 14 depicts a block diagram of a preferred embodiment of CTCSS Variant 3*a* of a condensation and thermal compression subsystems.
Figure 15:
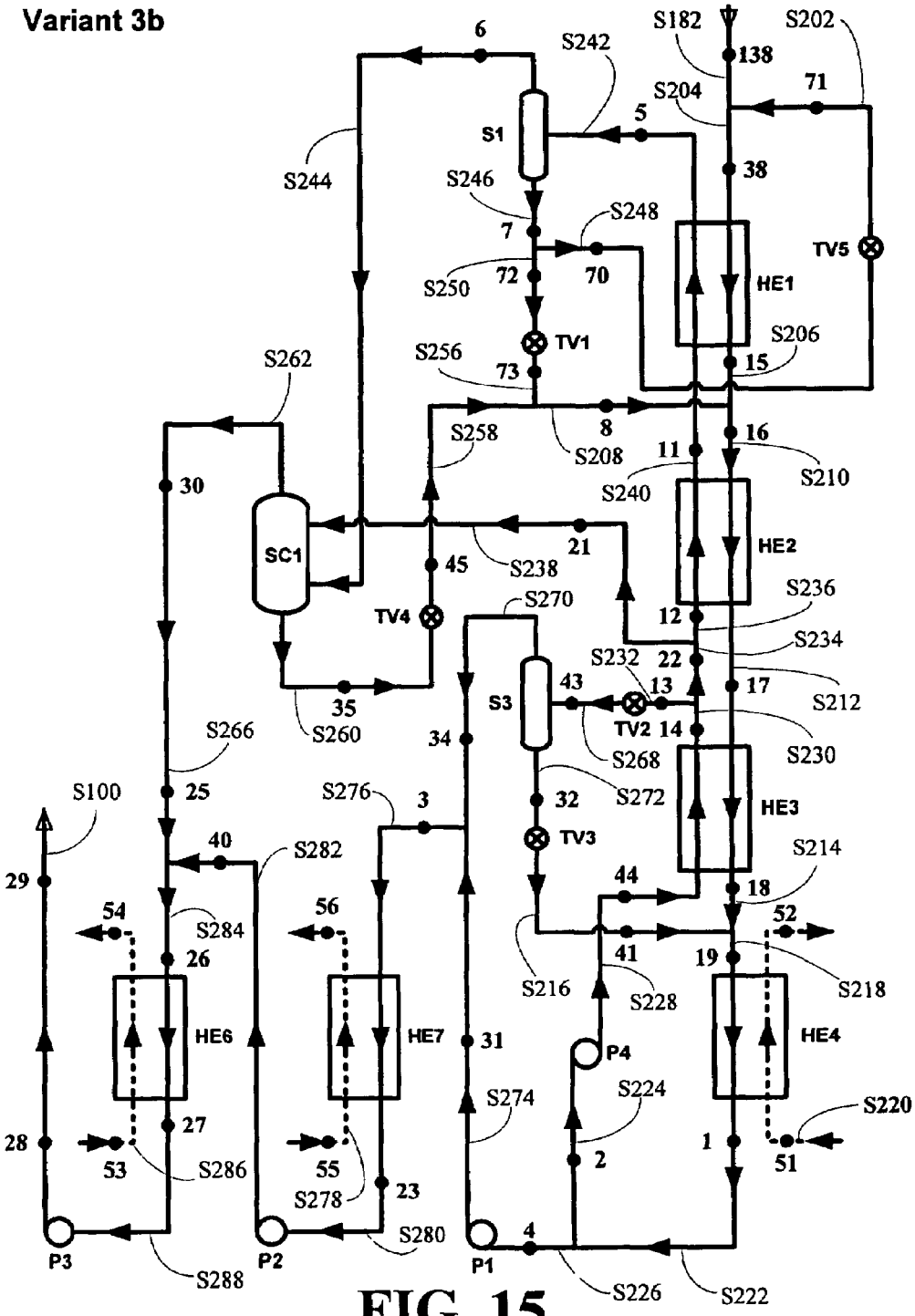
FIG. 15 depicts a block diagram of a preferred embodiment of CTCSS Variant 3*b* of a condensation and thermal compression subsystems.
Figure 16:
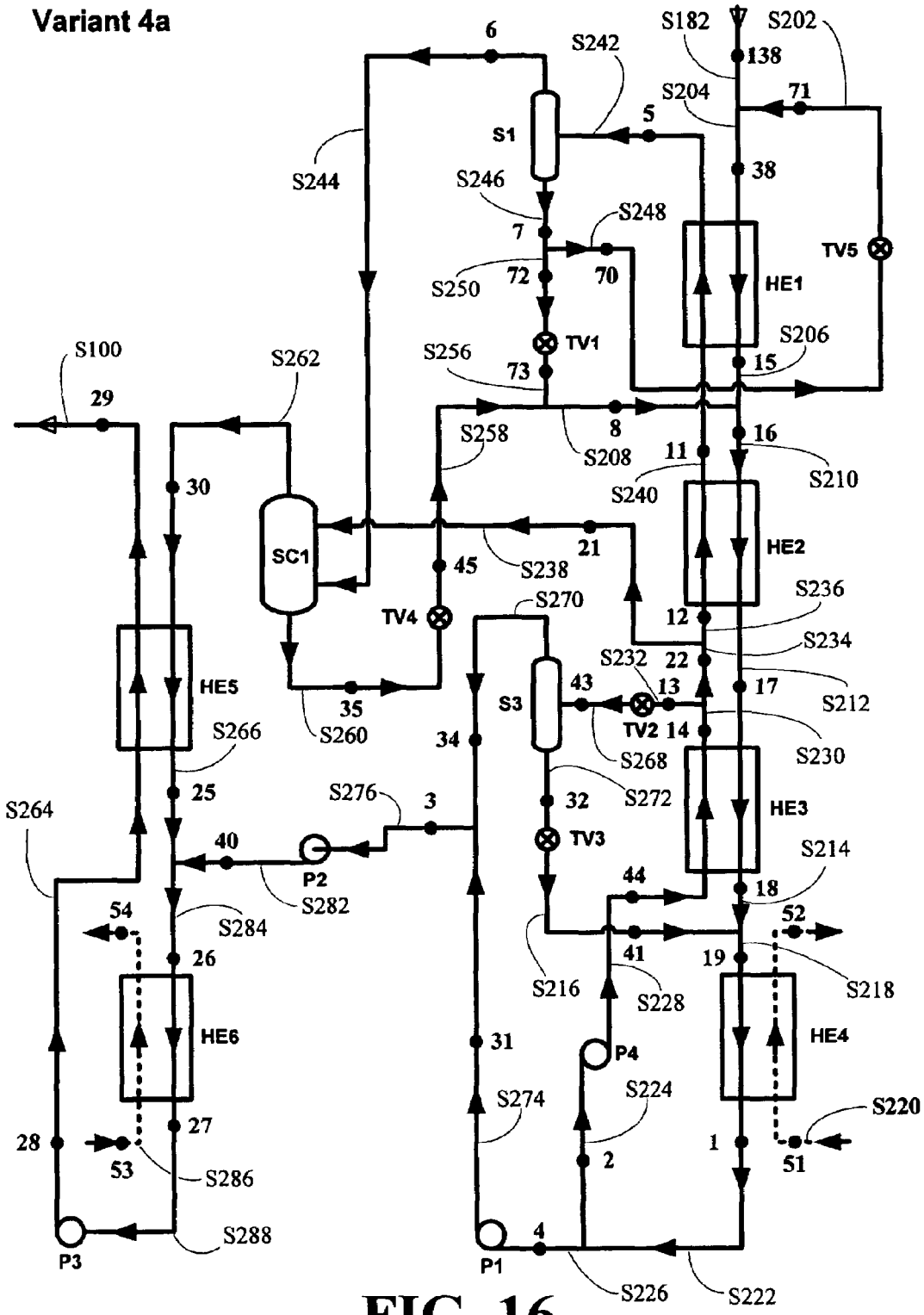
FIG. 16 depicts a block diagram of a preferred embodiment of CTCSS Variant 4*a* of a condensation and thermal compression subsystems.
Figure 17:
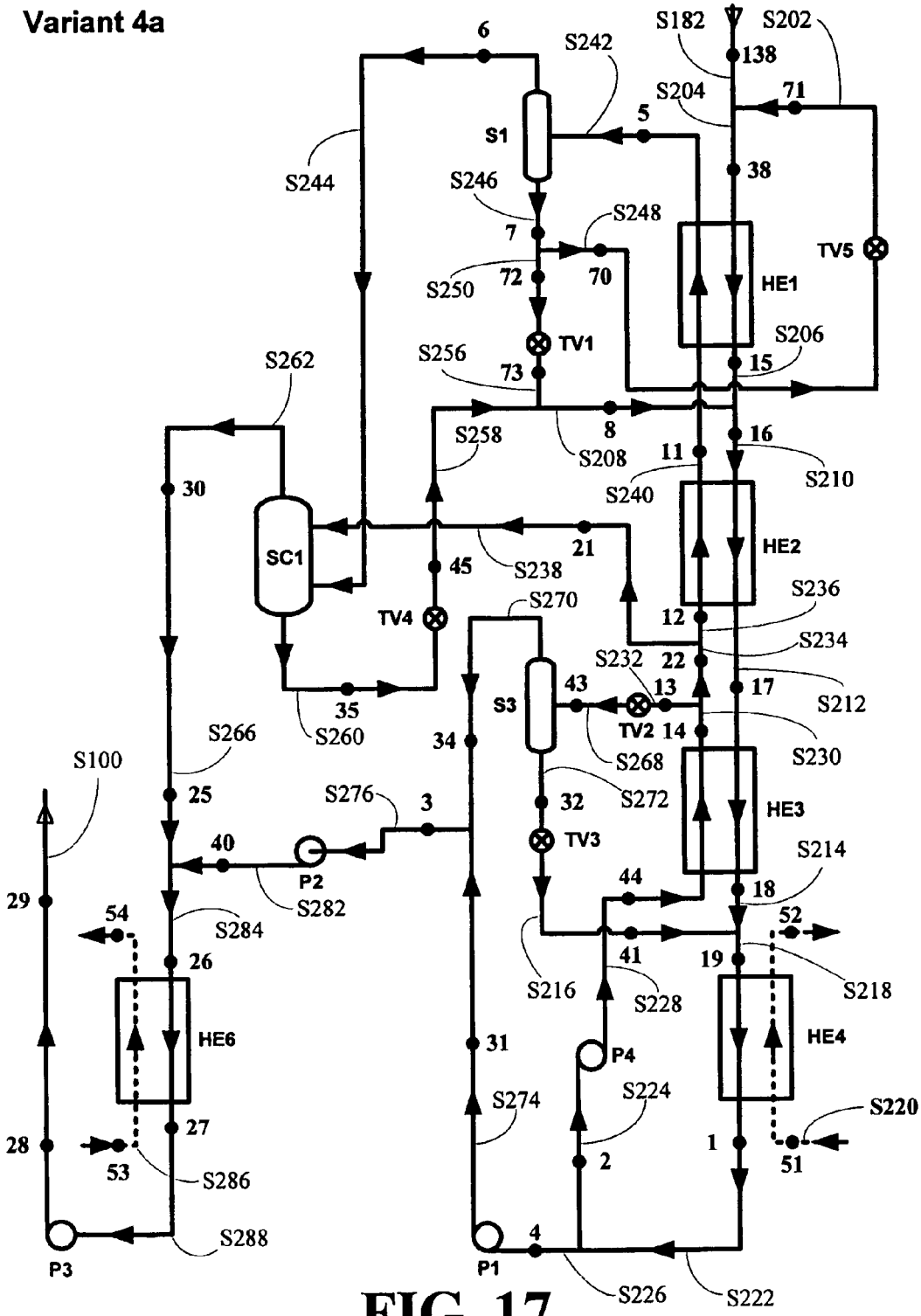
FIG. 17 depicts a block diagram of a preferred embodiment of CTCSS Variant 4*b* of a condensation and thermal compression subsystems.
Figure 18:
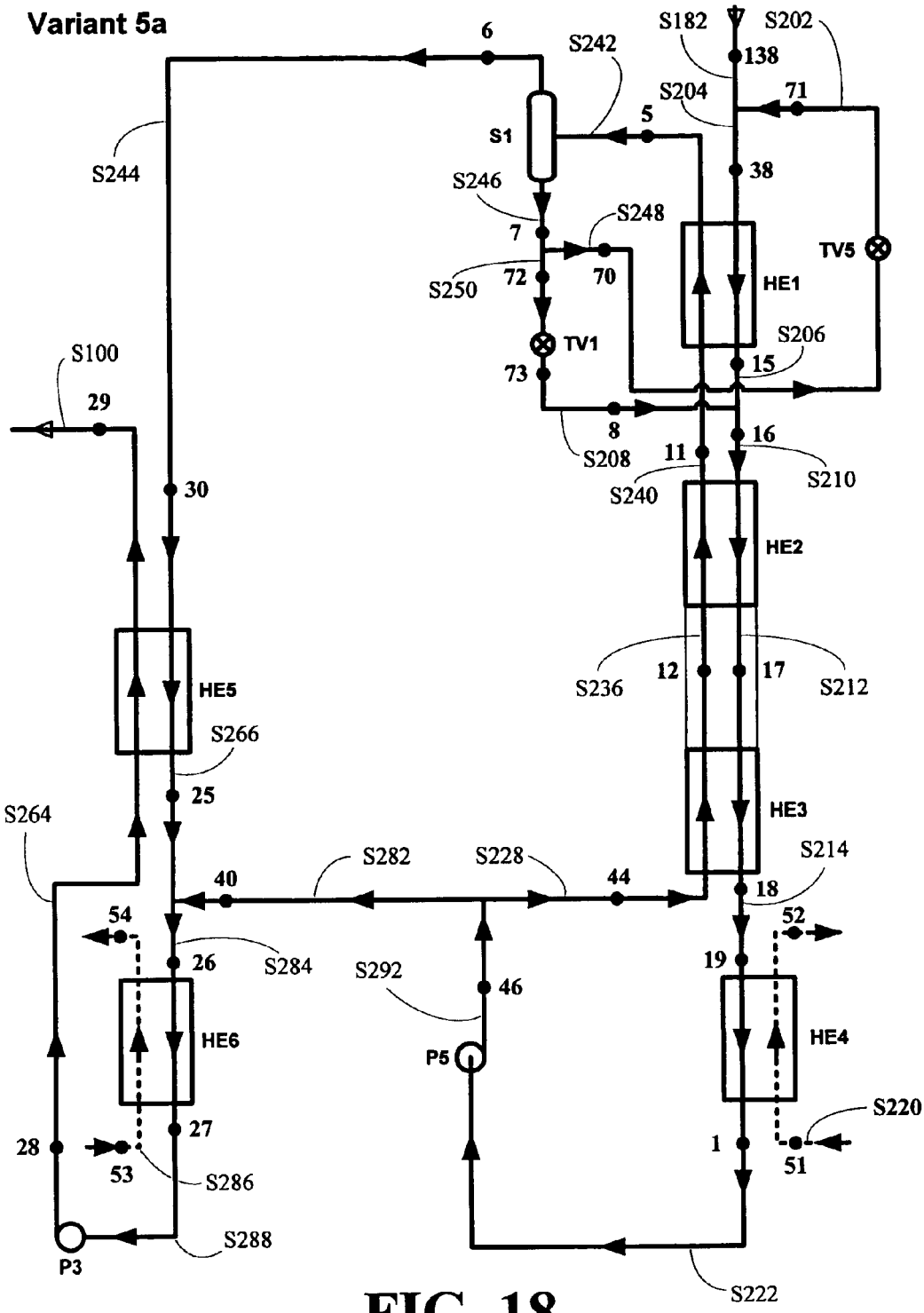
FIG. 18 depicts a block diagram of a preferred embodiment of CTCSS Variant 5*a* of a condensation and thermal compression subsystems.
Figure 19:
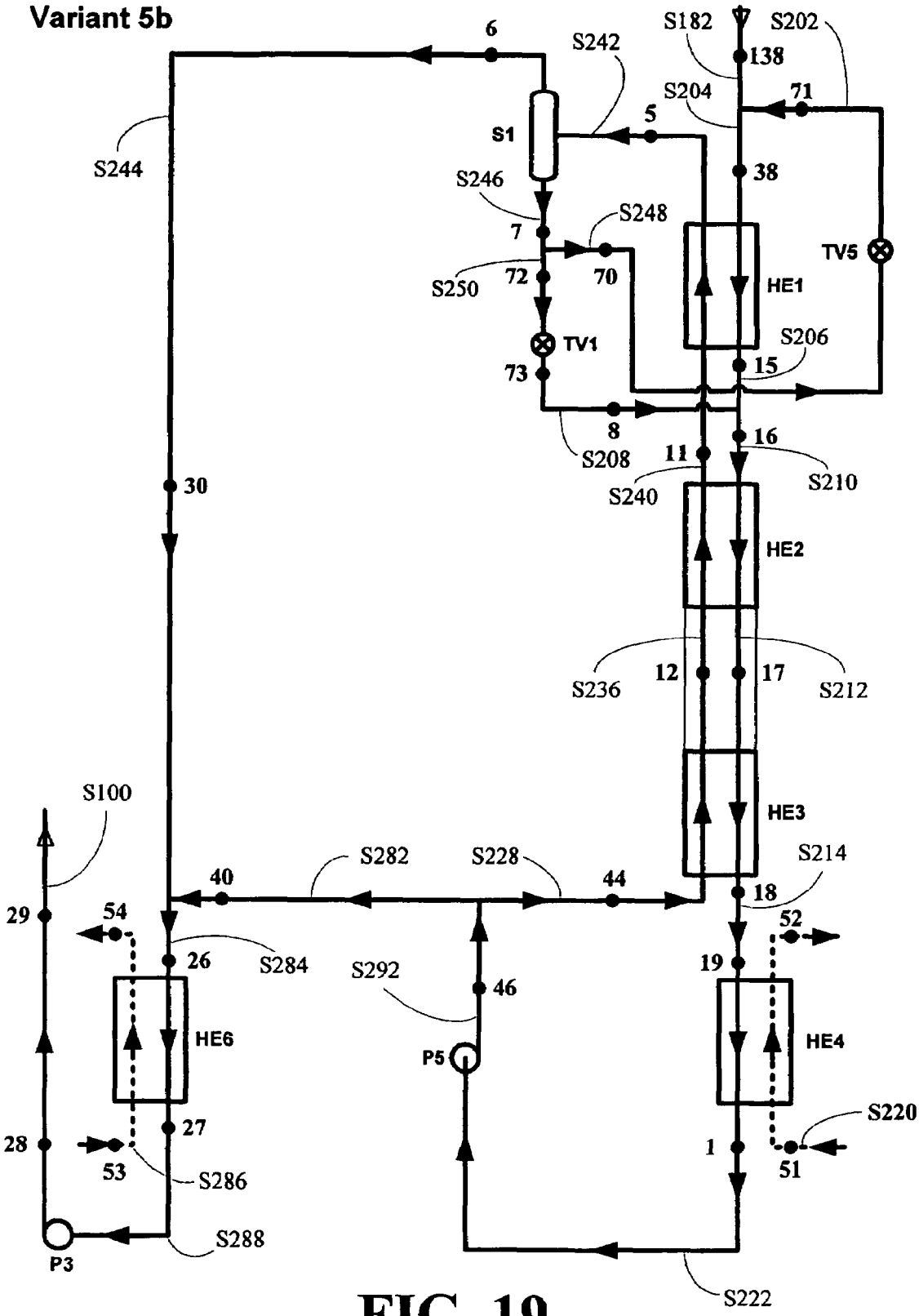
FIG. 19 depicts a block diagram of a preferred embodiment of CTCSS Variant 5*b* of a condensation and thermal compression subsystems.

A final modular simplification is attained by eliminating the scrubber SC1, and the use of the stream S282 having the parameters as at the point 40 without any enrichment, i.e., the composition of stream S282 having the parameters as at the point 40 is the same as the composition of the basic solution. This modular simplification of CTCSS Variant 4*a*, with preheating of the stream S264 of the working fluid having the parameters as at the point 28 is shown in FIG. 9, and is referred to as CTCSS Variant 5*a*. A similar simplification of CTCSS Variant 4*b*, without preheating the stream S264 of the working fluid having the parameters as at the point 28, is shown in FIG. 10, and referred to as CTCSS Variant 5*b*. It must be noted that the modular simplification of the CTCSS Variant 5*a* and CTCSS Variant 5*b* results in a substantial reduction of the efficiency of the CTCSS. Also in Variants 5*a* and 5*b*, the stream S222 having the parameters as at the point 1 is not split into two substreams S222 and S224 which are then separately pressurized, but is pressurized in as a single stream in a pump P5 forming a stream S292 having parameters as at a point 46. The stream S292 is then split to form the stream S228 having the parameters as at the point 44 and the stream S282 having the parameters as at the point 40.

The CTCSSs of this invention is described in the five basic variants given above; (two of which utilize external heat, and three of which utilize only the heat available from the stream S200 of the working fluid entering the CTCSSs of this invention). One experienced in the art would be able to generate additional combinations and variants of the proposed systems. For instance, it is possible to simplify CTCSS Variant 4*a* by eliminating the scrubber SC1, while retaining the enrichment of the stream S282 having the parameters as at the points 40. (Likewise it is possible to retain the scrubber SC1, and eliminate only the enrichment process for the stream S282 having the parameters as at the points 40.) However all such modular simplifications are still based on the initial CTCSS Variant 1*a* of the CTCSSs of this invention.

The efficacy of the CTCSS of this invention, per se, can be assessed by its compression ratio; i.e., a ratio of the pressure of the stream S284 having the parameters as at the point 26 (at the entrance to the high pressure condenser, heat exchanger HE6) to the pressure of the stream S182 having the parameters as at the point 138 (at the point of entrance of the stream of working solution into the CTCSS). The impact of the efficacy of the CTCSS on the efficiency of the whole system depends on the structure and parameters of work of the whole system. For assessing the CTCSSs of this invention, several calculations have been performed. A stream comprising a water-ammonia mixture having a composition of 0.83 weight fraction of ammonia (i.e., 83 wt. % ammonia), with an initial temperature of 1050° F. and an initial pressure of 1800 psia, has been expanded in a turbine with an isoenthropic efficiency of 0.875 (87.5%). The parameters of the vapor upon exiting the turbine correspond to the stream S182 having the parameters at the point 138. Such computations have been performed for all proposed "b" variants of the CTCSS of this invention described above, and for a simple condenser system as well.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that maybe made which do not depart from the scope and spirit of the invention as described above and claimed hereafter.

I claim:

1. A cascade power system comprising an energy extraction subsystem, a separation subsystem, a heat exchange subsystem, a heat transfer subsystem and a condensation subsystem, where the system is designed to establish two interacting working fluid cycles, one cycle utilizes a rich multi-component working fluid stream having a higher concentration of a low boiling component and the other cycle utilizes a lean working multi-component working fluid stream having a lower concentration of the low boiling component, where each stream is derived from a fully condensed incoming multi-component stream and a mixed stream having substantially the same composition as the fully condensed incoming multi-component stream designed to increase an amount of the circulating rich working fluid stream, where the separation subsystem designed to produce the lean and rich working fluid streams, where the heat exchange subsystem and the heat transfer subsystem are adapted to vaporize the lean working fluid stream and the rich working fluid stream from heat derived directly and/or indirectly from an external flue gas stream, where the energy extraction subsystem is adapted to extract energy from the lean working fluid stream in a separate lean working fluid stream turbine or turbine stages and the rich working fluid stream in a separate rich working fluid stream turbine or turbine stages, and where the condensation subsystem is adapted to condense a spent rich stream to form the fully condensed incoming multi-component stream.

2. The system of claim 1, wherein the energy extraction subsystem comprises a lean working fluid stream turbine, at least one rich working fluid stream turbine and at least two throttle control valves, where the lean working fluid stream turbine is adapted to extract energy from a lean working fluid stream, where the rich working fluid stream turbine is adapted to extract energy from a rich working fluid stream and where the first throttle control valve adjusts a pressure of a rich working fluid stream to that of a pressure of the rich working fluid stream turbine, where a second throttle control valve adjusts a pressure of the lean working fluid stream to a pressure of the lean working fluid stream turbine and optionally a third throttle control valve adjusts a pressure of an optional rich working fluid substream to a pressure of a leaner stream.

3. The system of claim 1, wherein the separation subsystem comprises a scrubber, a separator and three pumps, where the separation subsystem is adapted to form a lean stream and a make-up stream having a composition the same or substantially the same as an incoming working fluid stream.

4. The system of claim 1, wherein the heat exchange subsystem comprises at least four heat exchangers adapted to vaporize the rich steam and heat or partially vaporized the lean stream.

5. The system of claim 1, wherein the heat transfer subsystem comprises a heat transfer fluid, a heat transfer fluid pump and two heat exchangers, where the heat transfer subsystem is adapted to transfer heat from a hot flue gas stream to the heat transfer subsystem and then to transfer the absorbed heat of the heat transfer subsystem to the lean stream to vaporize the lean stream.

6. The system of claim 1, wherein the condensation subsystem comprising a condenser.

7. The system of claim 1, wherein the condensation subsystem comprising:

a condensation separation subsystem comprising a separator adapted to produce a rich vapor steam and a lean liquid stream;

a condensation heat exchange subsystem comprising three heat exchangers and two throttle control valves adapted to mix a pressure adjusted first portion of the lean liquid stream with an incoming stream to form a pre-basic solution stream, to mix a pressure adjusted second portion of the lean liquid stream with the pre-basic solution stream to form a basic solution stream, to bring a first portion of a pressurized fully condensed basic solution stream into a heat exchange relationship with the pre-basic solution stream to form a partially condensed basic solution stream;

a first condensing and pressurizing subsystem comprising a first condenser and a first pump adapted to fully condense the partially condensed basic solution stream to form a fully condensed basic solution stream and to pressurize the fully condensed basic solution stream to form a pressurized fully condensed working fluid stream; and a second condensing and pressurizing subsystem comprising a second condenser and a second pump adapted to mix a second portion of the fully condensed basic solution stream and the rich vapor stream to form an outgoing stream, to fully condense the outgoing stream and to pressurize the outgoing stream to a desired high pressure, where the first portion of the lean liquid stream is pressure adjusted to have the same or substantially the same pressure as the incoming stream and where the second portion of the lean stream is pressure adjusted to have the same or substantially the same pressure as the pre-basic solution stream and where the streams comprise at least one lower boiling component and at least one higher boiling component and the compositions of the streams are the same or different with the composition of the incoming stream and the outgoing stream being the same.

8. The system of claim 1, wherein the composition of the incoming multi-component stream is selected from the group consisting of an ammonia-water mixture, a mixture of two or more hydrocarbons, a mixture of two or more freons, and a mixture of hydrocarbons and freons.

9. The system of claim 1, wherein the composition of the incoming multi-component stream comprises a mixture of water and ammonia.

10. The system of claim 1, wherein the external flue gas stream comprises a combustion effluent stream formed from combustion of biomass, agricultural waste, municipal waste, coal, oil, natural gas and other fuels.

11. A cascade power system comprising:

a separation subsystem adapted to produce a lean working fluid stream and a rich working fluid stream form a combined stream comprising a fully condensed an incoming multi-component fluid stream comprising a low boiling component and a high boiling component and a mixed stream having substantially the same composition as the incoming multi-component stream designed to increase an amount of the circulating rich working fluid stream, where the lean working fluid stream comprises a lower concentration of a low boiling component and the rich stream has a higher concentration of the low boiling component, a heat exchange subsystem is adapted to heat and vaporize the rich working fluid stream and to heat the lean working fluid stream indirectly and directly from an external flue gas stream, a heat transfer subsystem is adapted to vaporize the lean working fluid stream indirectly from the external flue gas stream, an energy extraction subsystem is adapted to convert a portion of the thermal energy in the rich working fluid stream and the lean working fluid stream to a usable form of energy, and a condensation subsystem adapted to fully condensing the spent rich stream to form the fully condensed incoming working fluid stream, where the system establishes two interacting working fluid cycles, a lean stream cycle and a rich stream cycle designed to improve the efficiency of energy conversion of thermal energy from the external flue gas stream.

12. The system of claim 11, wherein the energy extraction subsystem comprises a lean stream turbine, at least one rich stream turbine and at least two throttle control valves, where the lean stream turbine is adapted to extract energy from a lean stream, where the rich stream turbine is adapted to extract from a rich stream and where the first throttle control valve adjusts a pressure of a rich stream to that of a pressure of the rich stream turbine, where a second throttle control valve adjusts a pressure of the lean stream to a pressure of the lean stream turbine and optionally a third throttle control valve adjusts a pressure of an optional rich substream to a pressure of a leaner stream.

13. The system of claim 11, wherein the separation subsystem comprises a scrubber, a separator and three pumps, where the separation subsystem is adapted to form a lean stream and a make-up stream having a composition the same or substantially the same as an incoming working fluid stream.

14. The system of claim 11, wherein the heat exchange subsystem comprises at least four heat exchangers adapted to vaporize the rich stream and heat or partially vaporized the lean stream.

15. The system of claim 11, wherein the heat transfer subsystem comprises a heat transfer fluid, a heat transfer fluid pump and two heat exchangers, where the heat transfer subsystem is adapted to transfer heat from a hot flue gas stream to the heat transfer subsystem and then to transfer the absorbed heat of the heat transfer subsystem to the lean stream to vaporize the lean stream.

16. The system of claim 11, wherein the condensation subsystem comprising a condenser.

17. The system of claim 11, wherein the condensation subsystem comprising:

a condensation separation subsystem comprising a separator adapted to produce a rich vapor stream and a lean liquid stream;

a condensation heat exchange subsystem comprising three heat exchangers and two throttle control valves adapted to mix a pressure adjusted first portion of the lean liquid stream with an incoming stream to form a pre-basic solution stream, to mix a pressure adjusted second portion of the lean liquid stream with the pre-basic solution stream to form a basic solution stream, to bring a first portion of a pressurized fully condensed basic solution stream into a heat exchange relationship with the pre-basic solution stream to form a partially condensed basic solution stream;

a first condensing and pressurizing subsystem comprising a first condenser and a first pump adapted to fully condense the partially condensed basic solution stream to form a fully condensed basic solution stream and to pressurize the fully condensed basic solution stream to form a pressurized fully condensed working fluid stream; and a second condensing and pressurizing subsystem comprising a second condenser and a second pump adapted to mix a second portion of the fully condensed basic solution stream and the rich vapor stream to form an outgoing stream, to fully condense the outgoing steam and to pressurize the outgoing stream to a desired high pressure, where the first portion of the lean liquid stream is pressure adjusted to have the same or substantially the same pressure as the incoming stream and where the second portion of the lean stream is pressure adjusted to have the same or substantially the same pressure as the pre-basic solution steam and where the streams comprise at least one lower boiling component and at least one higher boiling component and the compositions of the streams are the same or different with the composition of the incoming stream and the outgoing stream being the same.

18. The system of claim 11, wherein the external flue gas stream comprises a combustion effluent stream formed from combustion of biomass, agricultural waste, municipal waste, coal, oil, natural gas and other fuels.

19. The system of claim 11, wherein the composition of the incoming multi-component stream is selected from the group consisting of an ammonia-water mixture, a mixture of two or more hydrocarbons, a mixture of two or more freons, and a mixture of hydrocarbons and freons.

20. The system of claim 11, wherein the composition of the incoming multi-component stream comprises a mixture of water and ammonia.

21. A method comprising:

mixing a fully condensed incoming work fluid stream comprising a low boiling point component and a high boiling component with a pressurized cooled mixed stream to form a rich working fluid stream, where the incoming stream and the mixed stream have the same or substantially the same composition;

bringing the rich working fluid stream into a heat exchange relationship with a mixed stream to form a cooled mixed stream and a heated rich working fluid stream;

bringing the heated rich working fluid stream into a heat exchange relationship with a first portion of a cooled spent lean working fluid stream to form a hotter rich working fluid stream and a cooled first portion of cooled spent lean working fluid stream;

bringing the hotter rich working fluid stream into a heat exchange relationship with a spent lean working fluid steam to form a fully vaporized rich working fluid stream;

adjusting a pressure of the fully vaporized rich working fluid stream to a pressure of a rich working fluid stream turbine;

converting a portion of thermal energy in the fully vaporized rich working fluid stream into a first amount of a usable form of energy;

bringing the lean working fluid stream into a beat exchange relationship with a cooled external flue gas stream to form a heated lean working fluid stream;

bringing the heated lean working fluid stream into a heat exchange relationship with a circulating heat transfer fluid to form a fully vaporized lean working fluid stream, where the heat transfer fluid is heated by bringing the circulating heat transfer fluid into a heat exchange relationship with an external hot flue gas stream to form the cooled external flue gas stream;

adjusting a pressure of the fully vaporized lean stream to a pressure adjusted to a pressure of the lean working fluid stream turbine;

converting a portion of thermal energy in the fully vaporized lean working fluid stream into a second amount of the useable from of energy scrubbing a second portion of the cooled lean working fluid stream and a pressure adjusted first portion of a separator lean liquid stream to form a liquid lean working fluid stream and a rich scrubber stream;

pressurizing the liquid lean working fluid stream to a desired higher pressure to form the lean working fluid stream;

mixing the rich scrubber stream and the cooled second portion of the cooled spent lean working fluid stream to form a pre-separator feed stream;

separating the pre-separator feed stream to form a separator lean liquid stream and a separator rich liquid stream;

mixing a second portion of the separator lean liquid stream with the separator rich liquid stream to form the mixed stream; and condensing a spent rich working fluid stream to form the fully condensed incoming working fluid stream.

22. The method of claim 21, wherein the external flue gas stream comprises a combustion effluent stream formed from combustion of biomass, agricultural waste, municipal waste, coal, oil, natural gas and other fuels.

23. The method of claim 21, wherein the composition of the incoming multi-component stream is selected from the group consisting of an ammonia-water mixture, a mixture of two or more hydrocarbons, a mixture of two or more freons, and a mixture of hydrocarbons and freons.

24. The method of claim 21, wherein the composition of the incoming multi-component stream comprises a mixture of water and ammonia.

25. The method of claim 21, further comprising:

splitting the fully vaporized rich working fluid stream into two substream, one being forwarded to the rich working fluid stream turbine and the other being pressure adjusted and mixed with the heated lean working fluid stream prior to fully vaporization.

26. A method for efficient extraction of energy from a hot flue gas stream comprising the steps of:

establishing two interacting vaporization and energy extraction cycles, where one cycle utilizes a multi-component fluid stream having a higher concentration of a low boiling component of the multi-component fluid, a rich working fluid stream, and the other cycle utilizes a multi-component fluid stream having a higher concentration of a high boiling component of the multi-component fluid, a lean working fluid stream, each stream being derived from a hilly condensed incoming multi-component working fluid stream and a mixed stream having substantially the same composition as the fully condensed incoming multi-component stream designed to increase an amount of the circulating rich working fluid stream;

vaporizing the lean and rich working fluid streams utilized in the two interacting cycles from heat derived directly and/or indirectly form an external hot flue gas stream, where a portion of the indirect heating occurs via a heat transfer cycle utilizing a separately circulating heat transfer fluid to heat and vaporize the lean stream;

converting a portion of thermal energy associated with the lean working fluid stream and the rich working fluid stream to a usable form of energy to form a spent rich working fluid stream and a spent lean working fluid stream, separating a portion of the spent lean working fluid stream to form the lean working fluid stream and a make-up stream, where the make-up stream has a composition the same or substantially the same as the incoming multi-component working fluid stream; and condensing the spent rich working fluid stream to form the fully condensed incoming multi-component working fluid stream The spent rich stream is forwarded to a condensation unit, where it is fully condensed to form the incoming stream.

27. The method of claim 26, wherein the external flue gas stream comprises a combustion effluent stream formed from combustion of biomass, agricultural waste, municipal waste, coal, oil, natural gas and other fuels.

28. The method of claim 26, wherein the composition of the incoming multi-component stream is selected from the group consisting of an ammonia-water mixture, a mixture of two or more hydrocarbons, a mixture of two or more freons, and a mixture of hydrocarbons and freons.

29. The method of claim 26, wherein the composition of the incoming multi-component stream comprises a mixture of water and ammonia.

* * * * *